US008991966B2

(12) United States Patent
Arakane et al.

(10) Patent No.: US 8,991,966 B2
(45) Date of Patent: Mar. 31, 2015

(54) INKJET PRINTER

(71) Applicants: Satoru Arakane, Aichi (JP); Kenta Horade, Aichi (JP)

(72) Inventors: Satoru Arakane, Aichi (JP); Kenta Horade, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 46 days.

(21) Appl. No.: 13/853,214

(22) Filed: Mar. 29, 2013

(65) Prior Publication Data

US 2014/0035985 A1 Feb. 6, 2014

(30) Foreign Application Priority Data

Jul. 31, 2012 (JP) ..... 2012-170100

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 11/00*** | (2006.01) |

(52) U.S. Cl.

CPC ..... *B41J 13/0009* (2013.01); *B41J 11/005* (2013.01); *B41J 11/0095* (2013.01)

USPC ..... 347/16; 347/104

(58) Field of Classification Search

None

See application file for complete search history.

(56) References Cited

U.S. PATENT DOCUMENTS

| | | | | |
|---|---|---|---|---|
| 5,874,979 | A | 2/1999 | Ohyama | |
| 7,497,567 | B2 * | 3/2009 | Kumagai | 347/104 |
| 2009/0121422 | A1 | 5/2009 | Imoto | |
| 2009/0141067 | A1 | 6/2009 | Kato | |

FOREIGN PATENT DOCUMENTS

| | | | |
|---|---|---|---|
| JP | SHO 54-10012 | A | 1/1979 |
| JP | SHO 63-125364 | A | 5/1988 |
| JP | HEI 9-48161 | A | 2/1997 |
| JP | HEI 11-138923 | A | 5/1999 |
| JP | 2000-71532 | A | 3/2000 |
| JP | 2008-1522 | A | 1/2008 |
| JP | 2009-132108 | A | 6/2009 |

* cited by examiner

*Primary Examiner* — Lisa M Solomon

(74) *Attorney, Agent, or Firm* — Scully, Scott, Murphy & Presser, PC

(57) ABSTRACT

An inkjet printer including a feeding device configured to feed a sheet in a feeding direction, a platen configured to support the sheet, a recording device configured to eject ink on the sheet, contacting members configured to contact the sheet, a detector configured to detect an end portion position of the sheet in a width direction, and a controller configured to control the feeding device and the recording device is provided. The contacting members are arranged at intervals in the width direction, and the controller performs a suppression process in which at least one of the feeding device and the recording device is controlled to suppress a contact of the sheet with the recording device when the end portion position detected by the detector is a position between the two adjacent contacting members.

20 Claims, 13 Drawing Sheets

| |
|---|
| FIG. 9A |
| FIG. 9B |
| FIG. 9C |

INKJET PRINTER

CROSS-REFERENCE TO RELATED APPLICATION

This application claims priority under 35 U.S.C. §119 from Japanese Patent Application No. 2012-170100 filed on Jul. 31, 2012. The entire subject matter of the application is incorporated herein by reference.

BACKGROUND

1. Technical Field

The following description relates to an inkjet printer configured to eject ink on a sheet to form an image thereon.

2. Related Art

Conventionally, an inkjet printer including a recording head configured to eject ink on a sheet supported by a platen is known. In the inkjet printer, side end portions of the sheet may float (i.e., rise, or move away from the platen) when the ink is ejected.

A float suppressing structure configured to suppress such a float of the sheet has been suggested. The conventional float suppressing structure is configured to form the sheet into a corrugated shape having a wavelike shape in a width direction which is a direction perpendicular to a feeding direction. Specifically, the structure includes a plurality of sheet pressing plates having protrusions arranged in the width direction and a plurality of ribs, which are also arranged in the width direction and are formed on a platen. The plurality of protrusions contact one side of the sheet and the plurality of ribs contact the other side (i.e., a reverse side) of the sheet so that the sheet is formed into the corrugated shape. The stiffness of the sheet increases as formed into the corrugated shape, and thus, the floating of the sheet can be suppressed when the ink is ejected.

Additionally, an inkjet printer generally has a tray for accommodating a stack of sheets. The sheets are positioned in the tray by arranging a side end or a center of the sheets to align with a reference position in the width direction. Each sheet is fed from the tray to the platen with the position thereof in the width direction being maintained.

SUMMARY

If the sheets accommodated in the tray are not positioned properly, the sheet is fed from the tray to the platen with the position being displaced, in the width direction, from the proper position.

In the conventional float suppressing structure as described above, each protrusion of the sheet pressing plate and each rib of the platen are arranged alternately in the width direction. Therefore, if the sheet is displaced in the width direction, an end portion of the sheet in the width direction (hereinafter, referred to as a "side end") is likely to float. For example, when the side end is located between one of the ribs of the platen and one of the protrusions, the side end of the sheet is located at a ridge portion of the corrugated shape rather than a valley portion. Therefore, the side end of the sheet curves toward the recording head, and is likely to float. As a result, the side end of the sheet may contact the recording head.

In consideration of the above deficiencies, aspects of the present invention provide an inkjet printer having a configuration which forms a sheet into a corrugated shape and is capable of coping with a float of side end of the sheet.

Specifically, there is provided an inkjet printer including a feeding device configured to feed a sheet in a feeding direction, a platen configured to support the sheet fed by the feeding device, a recording device configured to eject ink from nozzles on a recording side of the sheet supported by the platen, a plurality of contacting members disposed between, in the feeding direction, the feeding device and the recording device and configured to contact the recording side of the sheet, a detector configured to detect an end portion position of the sheet in a width direction which is orthogonal to the feeding direction, and a controller configured to control the feeding device and the recording device. In addition, the contacting members are arranged at intervals in the width direction. Further, the controller performs a suppression process in which at least one of the feeding device and the recording device is controlled to suppress a contact of the sheet with the recording device when the end portion position detected by the detector is a position between the two adjacent contacting members.

There is also provided an inkjet printer including a feeding device configured to feed a sheet in a feeding direction, a platen configured to support the sheet fed by the feeding device, a recording device configured to eject ink from nozzles on a recording side of the sheet supported in the platen, a plurality of contacting members disposed in an upstream side of the recording device in the feeding direction and configured to contact the recording side of the sheet, a floating detector configured to detect a floating of an end portion of the sheet and a controller configured to control the feeding device and the recording device. In addition, the contacting members are arranged at intervals in a width direction which is orthogonal to the feeding direction. Further, the controller performs a suppression process in which at least one of the feeding device and the recording device is controlled to suppress a contact of the sheet with the recording device when the floating of the end portion of the sheet is detected by the floating detector.

There is also provided an inkjet printer including a feeding device configured to feed a sheet in a feeding direction, a recording device configured to eject ink from nozzles on a recording side of the sheet while moving in a width direction which is orthogonal to the feeding direction, a first contacting member disposed in an upstream side of the nozzles in the feeding direction and configured to contact the recording side of the sheet at a plurality of contact points in the width direction, a second contacting member disposed in the upstream side of the nozzles in the feeding direction and configured to contact a back side, which is a reverse side of the recording side, of the sheet at a plurality of contact points in the width direction, a detector having an optical sensor carried by the recording device and configured to detect an end portion position of the sheet in the width direction, and a controller configured to control the feeding device and the recording device. In addition, the first contacting member contacts the end portion of the sheet when the sheet is position within a predetermined range. Further, the controller controls the feeding device and the recording device to perform an image printing process in which an image is printed on the sheet when the sheet is located within the predetermined range, and the controller controls the feeding device and the recording device to restricts an operation of the feeding device and the recording device to restrict the image printing process when the sheet is not located within the predetermined range.

BRIEF DESCRIPTION OF THE ACCOMPANYING DRAWINGS

DETAILED DESCRIPTION

Hereinafter, an embodiment according to aspects of the invention will be described with reference to the accompany drawings. It is noted that various connections are set forth between elements in the following description. It is noted that these connections in general and, unless specified otherwise, may be direct or indirect and that this specification is not intended to be limiting in this respect. The following description refers to an up-and-down direction 7, a front-and-rear direction 8 and a right-and-left direction 9, which are defined in the accompanying drawings.

Figure 1:
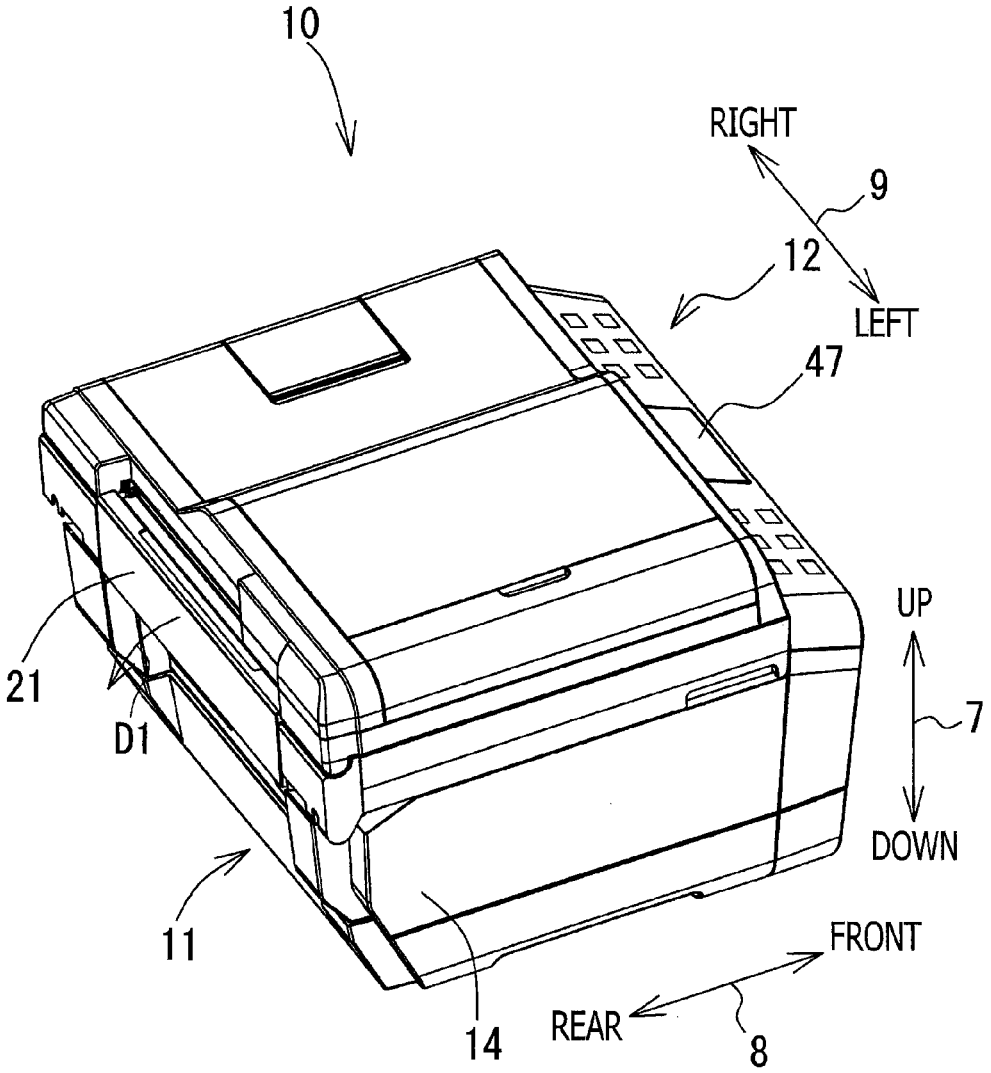
FIG. 1 is a perspective view showing a multifunction peripheral according to an aspect of the present invention.

As shown in FIG. 1, an MFP (Multifunction Peripheral) 10 has a substantially cuboid shape, and an inkjet type printing unit 11 is disposed in a lower part of the MFP 10. The printing unit 11 includes a housing 14 having an opening on its front face. A sheet feed tray 20 can be inserted into/drawn from the housing 14 through the opening in the front-and-rear direction 8. The sheet feed tray 20 (FIG. 2) is configured to accommodate print sheets 35 in a stacked manner. The print sheets 35 may be any one of a various types of sheets.

Figure 6:
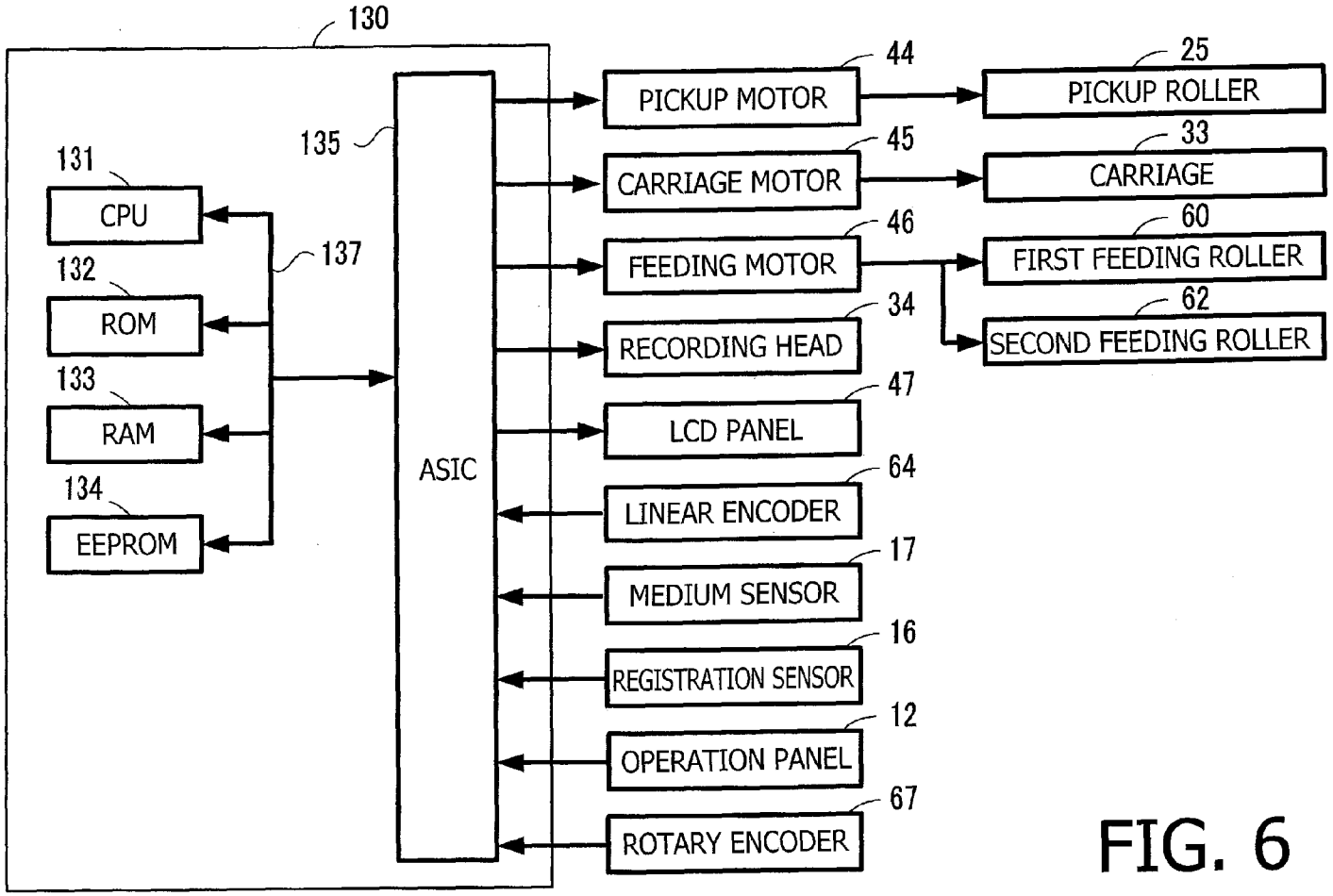
FIG. 6 is a block diagram showing a configuration of a controller.

On a front face of the MFP 10, an operation panel 12 that generates a predetermined operation signal in response to a user operation is provided. The operation panel 12 includes an LCD (Liquid Crystal Display) panel 47 that displays a various kinds of information necessary for operations of the MFP 10. The operation panel 12 is electrically connected to a controller 130 (FIG. 6).

Figure 2:
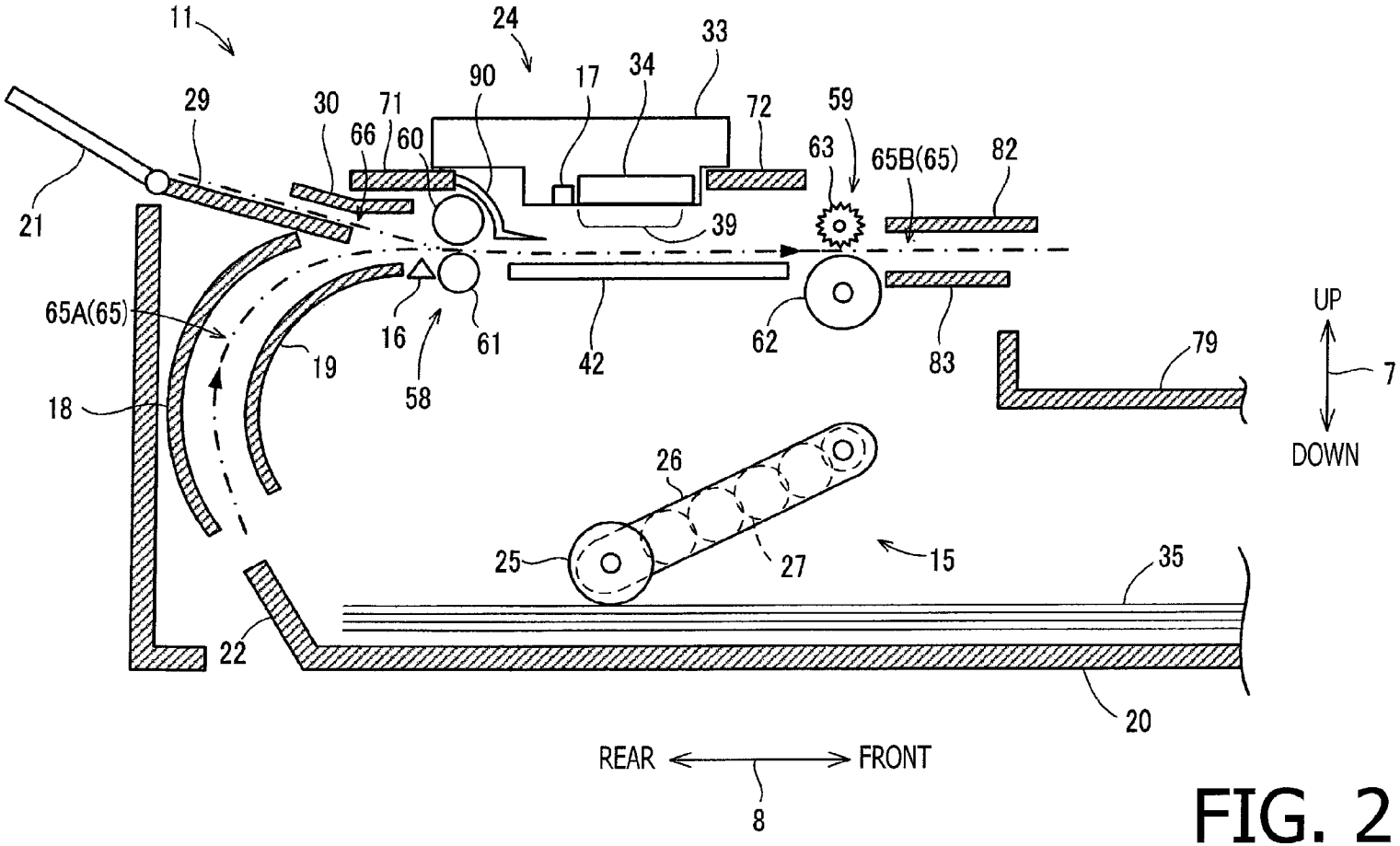
FIG. 2 is schematic diagram showing a printing unit.

At a rear face of the MFP 10, a manual feed tray 21 is disposed. In a state shown in FIG. 1, the manual feed tray 21 stands up to configure a part of the rear face of the MFP 10. The manual feed tray 21 may rotate about a lower end thereof in a direction D1 so as to be located at an open position, which is shown in FIG. 2. The user can place an arbitrary size of a print sheet 35 for printing on the manual feed tray 21 when located at the open position.

[Printing Unit 11]

As shown in FIG. 2, the printing unit includes a sheet supplying unit 15 configured to pick up the print sheet 35 from the sheet feed tray 20 and feed the print sheet 35, and an inkjet type of recording device 24 configured to form an image on the print sheet 35 by ejecting ink on the print sheet 35 which is fed by the sheet supplying unit 15 from the sheet feed tray 20 or loaded on the manual feed tray 21. The recording device 24 is disposed above the sheet feed tray 20.

[Sheet Supplying Unit 15]

As shown in FIG. 2, the sheet supplying unit 15 includes a pickup roller 25, a support arm 26, and a driving force transport mechanism 27. The pickup roller 25 is rotatably supported by the support arm 26. Additionally, the pickup roller 25 is rotated by a driving force, which is transported from a pickup motor 44 (FIG. 6) by the driving force transport mechanism 27. The driving force transport mechanism 27 includes a plurality gears engaged with each other and disposed in the support arm 26. The pickup roller 25 feeds the sheet 35 to a curved path 65A.

[Feeding Path 65]

As shown in FIG. 2, inside the printing unit 11, a feeding path 65 is formed from a rear end of the sheet feed tray 20 to a discharge tray 79 through the recording device 24. The feeding path 65 includes the curved path 65A formed from the rear end of the sheet feed tray 20 to the recording device 24 and a discharge path 65B formed from the recording device 24 to the discharge tray 79.

The curved path 65A is a path having a curved shape extending from a vicinity of an upper end of an inclined part 22 of the sheet feed tray 20 to the recording device 24. The curved path 65A forms substantially a part of a circular arc of which center is located inside the printing unit 11. The print sheet 35 fed from the sheet feed tray 20 is guided to under the recording device 24 with the print sheet 35 being curved in a feeding direction (i.e., a direction of an arrow indicated in chain line in FIG. 2) at the curved path 65A. The curved path 65A is formed with an outside guide member 18 and an inside guide member 19 which are arranged to face each other with a clearance.

The discharge path 65B is a straight path extending from just below the recording device 24 to the discharge tray 79. The print sheet 35 is fed through the discharge path 65B in the feeding direction. The part of the discharge path 65B, on which the recording device 24 does not exists, is formed with an upper guide member 82 and a lower guide member 83 which are arranged to face each other with a clearance.

On a downstream side of the curved path 65A in the feeding direction, a registration sensor 16 is disposed. The registration sensor 16 may be an optical sensor or a mechanical sensor of which shape is changed by the print sheet 35. The registration sensor 16 transmits a signal to the controller 130 based on an existence or non-existence of the print sheet 35.

[Manual Feed Tray 21 and Side Path 66]

As shown in FIG. 2, the lower end of the manual feed tray 21 is rotatably connected to a guide member 29. As described above, the manual feed tray 21 may rotate around the lower end in the direction D1 so that the print sheet 35 can be loaded on the inclined surface of the manual feed tray 21 as shown in FIG. 2. In the state shown in FIG. 2, the manual feed tray 21 extends obliquely upward from the rear end of the printing unit 11.

The controller 130 controls to feed the print sheet 35 loaded on the sheet feed tray 20 or the manual feed tray 21 to under the recording device 24 for printing an image thereon. The controller 130 determines that the print sheet 35 loaded on which tray should be printed based on the existence of the print sheet 35 on the each tray and setting values stored in an EEPROM (Electrically Erasable Programmable Read-Only Memory) 134 (FIG. 6).

A side path 66 is formed from a downstream side of the manual feed tray 21 to the inside of the printing unit 11. The side path 66 is formed with the guide member 29 and a guide member 30 facing each other in the up-and-down direction 7. The side path 66 is communicated with a downstream side of the curved path 65A. The downstream side of the print sheet 35 loaded on the manual feed tray 21 in the feeding direction is fed to the side path 66. The downstream side of the print sheet 35 faces the registration sensor 16 at a nipping position of a first roller unit 58. The print sheet 35 loaded on the manual feed tray 21 is detected by the registration sensor 16. When the first roller unit 58 rotates with the print sheet 35 being nipped by the first roller unit 58, the print sheet 35 is drawn into the feeding path 65 so as to be fed to the recording device 24.

[Recording Device 24]

Figure 3:
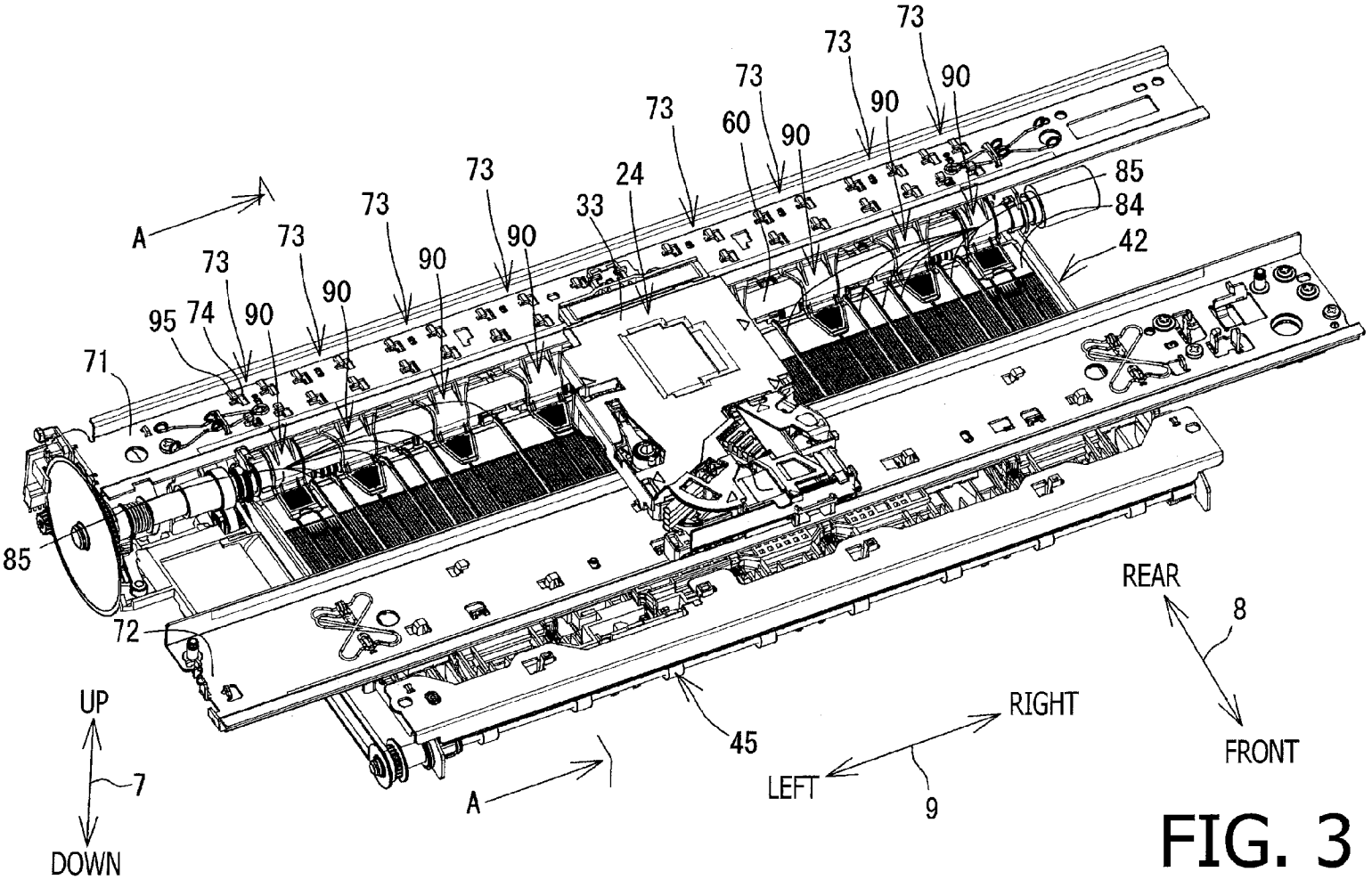
FIG. 3 is a perspective view showing a recording device and periphery thereof.

As shown in FIGS. 2 and 3, the recording device 24 is disposed above the sheet feed tray 20. The recording device 24 includes a carriage 33 and a recording head 34 carried by the carriage 33. The carriage 33 is supported by a first guide rail 71 and a second guide rail 72. The first guide rail 71 and the second guide rail 72 have substantially a plate shape of which longitudinal direction is parallel to the right-and-left direction 9. The first guide rail 71 and the second guide rail 72 are arranged to face each other in the front-and-rear direction 8 with a clearance therebetween. The carriage 33, which carries the recording head 34, reciprocates in the right-and-left direction 9 by a driving force transmitted from a carriage motor 45 (FIG. 6) via well known drive force transmission mechanism. The first guide rail 71 and the second guide rail 72 function as rails on which the carriage 33 reciprocates in the right-and-left direction 9.

A platen 42 that supports the print sheet 35 fed from the first roller unit 58 is disposed below the recording device 24. The platen 42 faces the recording device 24 across the feeding path 65. The recording head 34 ejects ink supplied from an ink cartridge (not shown) to the print sheet 35 that is fed on the platen 42 while moving (i.e., reciprocating) in the right-and-left direction 9. The recording head 34 ejects the ink from a plurality of nozzles formed on a nozzle face 39 at a bottom face of the recording head 34. According to this, an image is printed on the print sheet 35.

On the carriage 33 and the second guide rail 72, an optical linear encoder 64 (FIG. 6) which is electrically connected to the controller 130 is provided. The linear encoder 64 includes an encoder strip (not shown) disposed on the second guide rail 72 along the right-and-left direction 9 and a reading head (not shown) carried on the carriage 33 and configured to read the encoder strip. The reading head generates a pulse signal indicating a travel distance relative to the encoder strip, and transmits the pulse signal to the controller 130.

An optical medium sensor 17 which is electrically connected to the controller 130 is carried by the carriage 33. The medium sensor 17 includes a light-emitting element and a light-receiving element arranged to face the platen 42 or the print sheet 35 loaded on the platen 42. The light-emitting element emits light to the platen 42 or the print sheet 35 and the light-receiving element receives the light reflected from the platen 42 or the print sheet 35. The light-receiving element generates and transmits a light-receiving signal indicating an amount of the light received.

[Feeding Rollers 60 and 62]

As shown in FIG. 2, the first roller unit 58 having a first feeding roller 60 and a nipping roller 61 is disposed on the upstream side of the recording device 24 in the feeding direction. The nipping roller 61 is disposed below the first feeding roller 60 and urged to the periphery of the first feeding roller 60 by an urging member such as a spring (not shown). The first roller unit 58 nips the print sheet 35 fed from the curved path 65A or the side path 66 and feeds the print sheet 35 to the platen 42.

On the downstream side of the recording device 24 in the feeding direction, a second roller unit 59 having a second feeding roller 62 and a spur roller 63 is disposed. The spur roller 63 is disposed above the second feeding roller 62 and urged to a periphery of the second feeding roller 62 by an urging member such as a spring (not shown). The second feeding roller 62 and the spur roller 63 nip the print sheet 35 on which the image is printed by the recording device 24 and feed the print sheet 35 to the discharge tray 79 disposed on the downstream side in the feeding direction.

The first feeding roller 60 and the second feeding roller 62 are rotated by the driving force generated by the feeding motor 46 (FIG. 6) and transmitted by the driving force transmitting mechanism (not shown). According to this configuration, the print sheet 35 is fed in the feeding direction and discharged to the discharge tray 79.

Around the first feeding roller 60, an optical rotary encoder 67 (FIG. 6) electrically connected to the controller 130 is disposed. The rotary encoder 67 includes a disk (not shown) that rotates together with the first feeding roller 60, a light-emitting element and a light-receiving element which face with each other across the disk (not shown). On the disk, a plurality of slits are formed at regular intervals along a circumferential direction. When the slit is located between the light-emitting element and the light-receiving element, the light emitted from the light-emitting element is received by the light-receiving element. Thus, an amount of the received light in the light-receiving element increases temporarily and a signal generated by the rotary encoder 67 changes significantly. Accordingly, a number of the changes of the signal indicates a rotating amount of the first feeding roller 60. The rotary encoder 67 transmits the signal indicating the rotating amount of the first feeding roller 60 to the controller 130 as a pulse signal.

[Platen 42]

Figure 4:
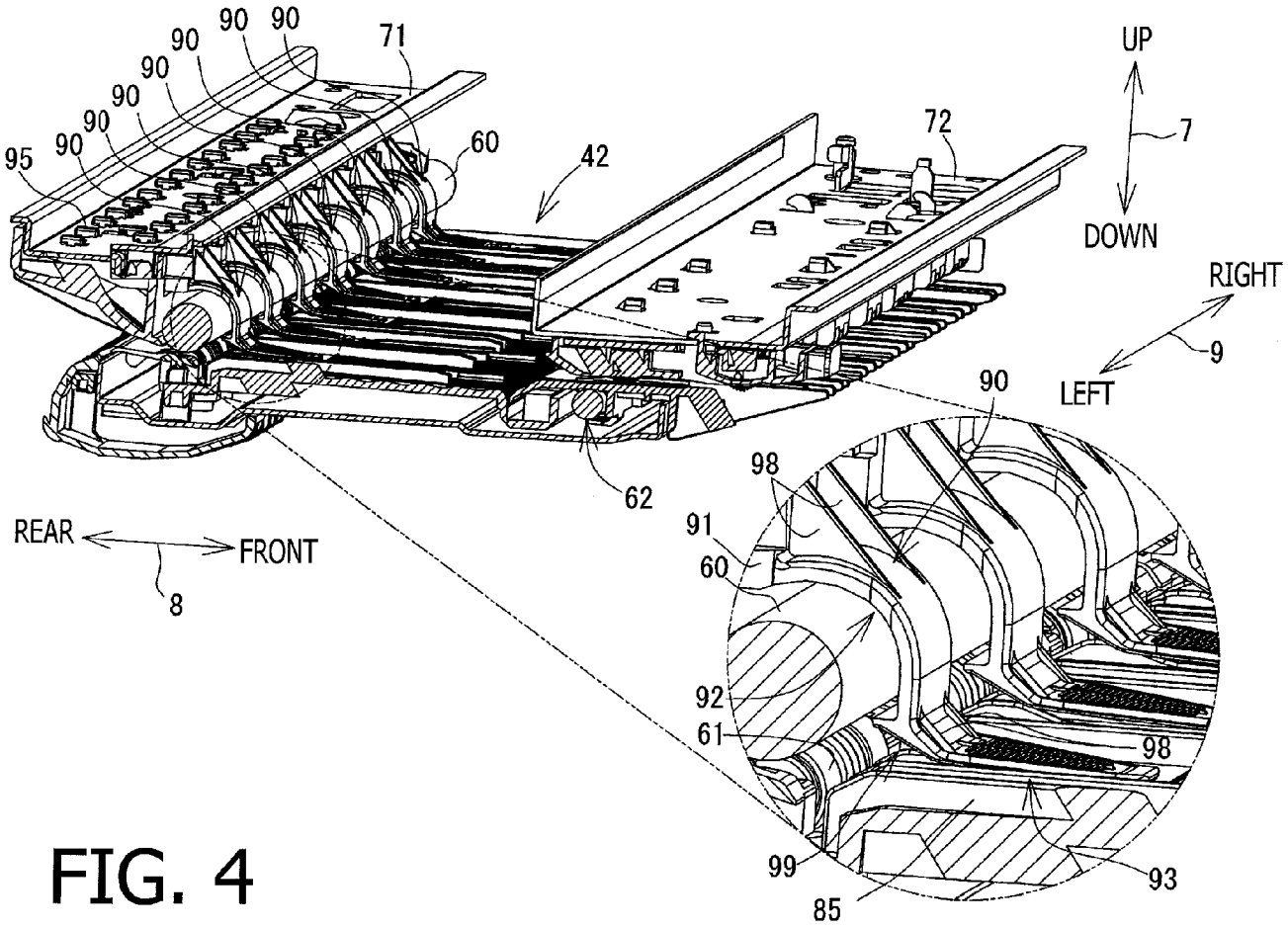
FIG. 4 is a cross sectional perspective view sectioned in A-A line shown in FIG. 3.

As shown in FIGS. 2 through 4, the platen 42 is disposed on the downstream side of the first roller unit 58 (i.e., forward in the front-and-rear direction 8). The platen 42 has a supporting surface 84 (FIG. 3) on an upper side to face the recording device 24. The supporting face 84 is exposed at the feeding path 65 (FIG. 2), and formed a part of the lower face of the feeding path 65. A plurality of ribs 85 are protruded up from the supporting face 84. The plurality of ribs 85 extend along the front-and-rear direction 8, and are arranged in the right-and-left direction 9 at intervals.

[First Guide Rail 71]

As shown in FIG. 3, the first guide rail 71 is disposed above the first feeding roller 60 and near the rear end of the platen 42 in the front-and-rear direction 8. The first guide rail 71 is disposed so that both surface of the first guide rail 71 are substantially parallel to the supporting face 84. The first guide rail 71 is disposed along the feeding path 65 in the right-and-left direction 9, and the both end thereof is supported by frames (not shown). The first guide rail 71 includes a plurality of attaching parts 73 along the right-and-left direction 9 to which pressing members 90 are attached. The each attaching part 73 is formed by four inserting holes 74 which penetrate the first guide rail 71 in the up-and-down direction 7. The pressing members 90 are attached to the first guide rail 71 by inserting protrusions 95 (FIGS. 3 to 5) of the pressing members 90 into the inserting holes 74.

[Pressing Member 90]

The pressing members 90 form the print sheet 35 into the corrugated shape by pressing the print sheet 35 with the ribs 85 from both directions. The each pressing member 90 is disposed between the each rib 85 in the right-and-left direction 9. The pressing members 90 are attached to the attaching parts 73 and face the supporting face 84 of the platen 42 with a clearance. One of the pressing members 90 is disposed at the center of the feeding path 65 in the right-and-left direction 9 although it is covered by the carriage 33 and not shown in FIG. 3 (hereinafter, referred to as a "central pressing member 90"). Four pressing members 90 are disposed on each side of the central pressing member 90 in the right-and-left direction 9 at intervals. That is, a total of nine pressing members 90 are disposed along the right-and-left direction 9.

The central pressing member 90 presses a center of the print sheet 35 in the right-and-left direction 9. That is, a center of the print sheet 35 is fed to be pressed by the central pressing member 90 irrespective of a size of the print sheet 35. The print sheet 35 pressed between the ribs 85 and the pressing members 90 is formed in the corrugated shape that is bilaterally symmetric with respect to the central pressing member 90. The print sheet 35 on the sheet feed tray 20 or the manual feed tray 21 is positioned so that the center of the print sheet 35 meets the position of the central pressing member 90.

Hereinafter, a configuration of the pressing members 90 is described with reference to FIGS. 4 and 5A through 5F. The shape of the pressing members 90 disposed at both ends (hereinafter, referred to as "end pressing members") is different from the other pressing members 90 (including the central pressing member 90). It is noted that the following descriptions are directed to the pressing members 90 other than the end pressing members 90. The difference in the shapes between the pressing members 90 and the end pressing members 90 are described later. It is noted that the up-and-down direction 7, the front-and-rear direction 8, and the right-and-left direction 9 shown in FIGS. 5A through 5F are directions where the pressing members 90 are attached to the first guide rail 71.

As shown in FIGS. 4 and 5A through 5F, the pressing members 90 is a plastics molding member formed with a plate-like base part 91, a curved part 92 and a pressing part 93. The curved part 92 curves down from a forward end of the base part 91 in the front-and-rear direction 8. The pressing part 93 extends obliquely downward from the lower end of the curved part 92. That is, the pressing part 93 is slightly inclined in a horizontal direction. On the upper face of the base part 91, a plurality of reinforcing ribs 94 (FIGS. 5B and 5F) and four protrusions 95 (FIGS. 3, 4 and 5A through 5F) are provided. The four protrusions 95 are arranged two by two in the front-and-rear direction 8 and the right-and-left direction 9, and to be inserted into the inserting holes 74 (FIG. 3) formed on the first guide rail 71.

On a tip (upper end) of the each protrusion 95, a pair of stops 96 and 97 (FIGS. 5A through 5F) to be hooked at an upper face of the first guide rail 71 is formed. The stop 96 projects forward from the tip of the each protrusion 95 in the front-and-rear direction 8. And the stop 97 projects rearward from the tip of the each protrusion 95 in the front-and-rear direction 8. Upon attaching the pressing members 90 to the first guide rail 71, the protrusions 95 are inserted into the inserting holes 74 of the first guide rail 71 from below and then the pressing members 90 is slid to left in the right-and-left direction 9. According to this configuration, the stops 96 and 97 are engaged with the inserting holes 74 and the pressing members 90 are fixed to the first guide rail 71.

The curved part 92 is curved in a circular arc so that the curved part 92 is prevented from contacting the first feeding roller 60. The curved part 92 is reinforced by the reinforcing ribs 98 so as not to bend. An inclined face 99 extending obliquely downward from the lower end of the curved part 92 is formed in the front-and-rear direction 8. On the inclined face 99, a plurality of guide ribs 99A (FIG. 5A) extending forward and obliquely downward (i.e., a direction which the inclined face 99 are inclined) are formed. The plurality of guide ribs 99A are arranged at intervals in the right-and-left direction 9. According to the tips of the guide ribs 99A, the downstream side end portion of the print sheet 35 in the feeding direction is guided to the pressing part 93.

Figure 5B:
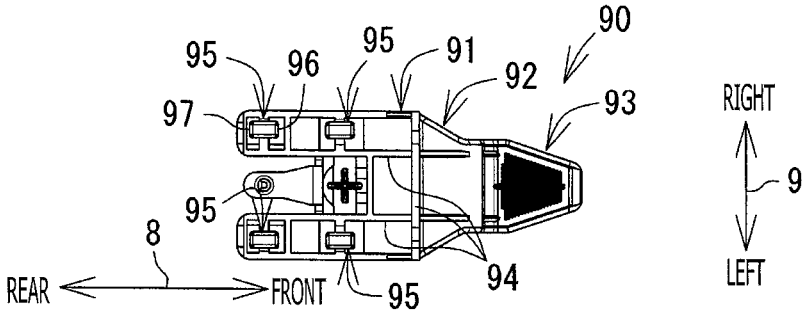
FIG. 5B is a plane view of the pressing member.
Figure 5C:
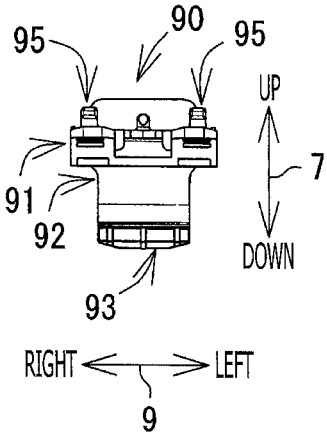
FIG. 5C is a rear side view of the pressing member.
Figure 5A:
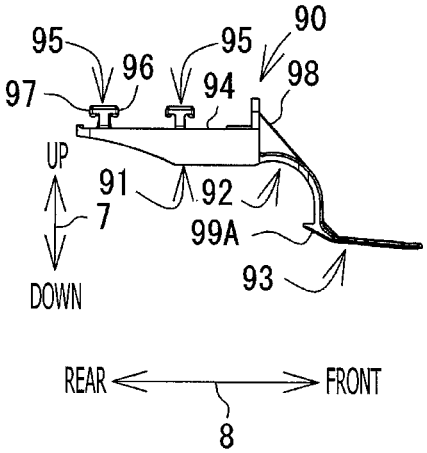
FIG. 5A is a left side view of a pressing member.
Figure 5D:
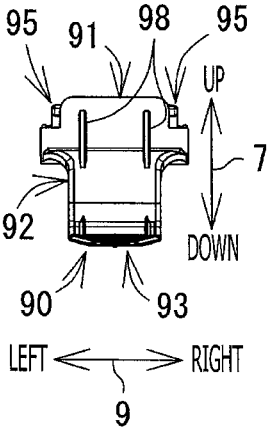
FIG. 5D is a front side view of the pressing member.
Figure 5F:
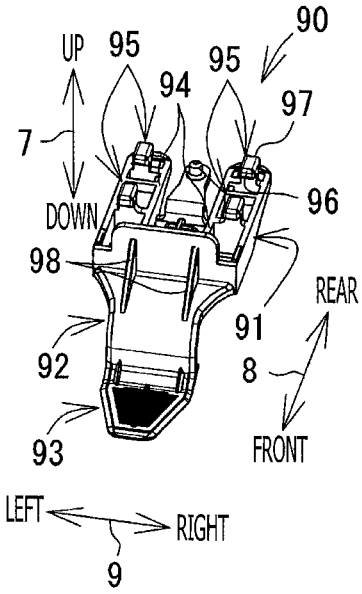
FIG. 5F is a perspective view of the pressing member.
Figure 5E:
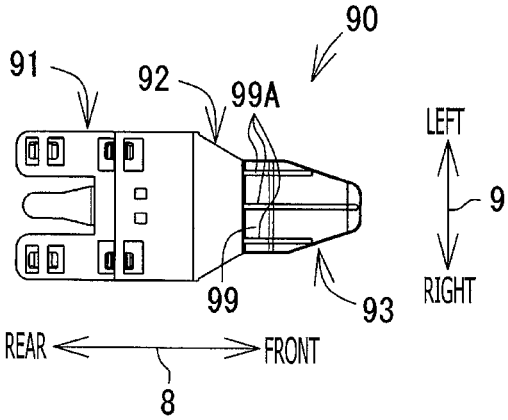
FIG. 5E is a bottom view of the pressing member.
Figures 8A, 8B, 8C:
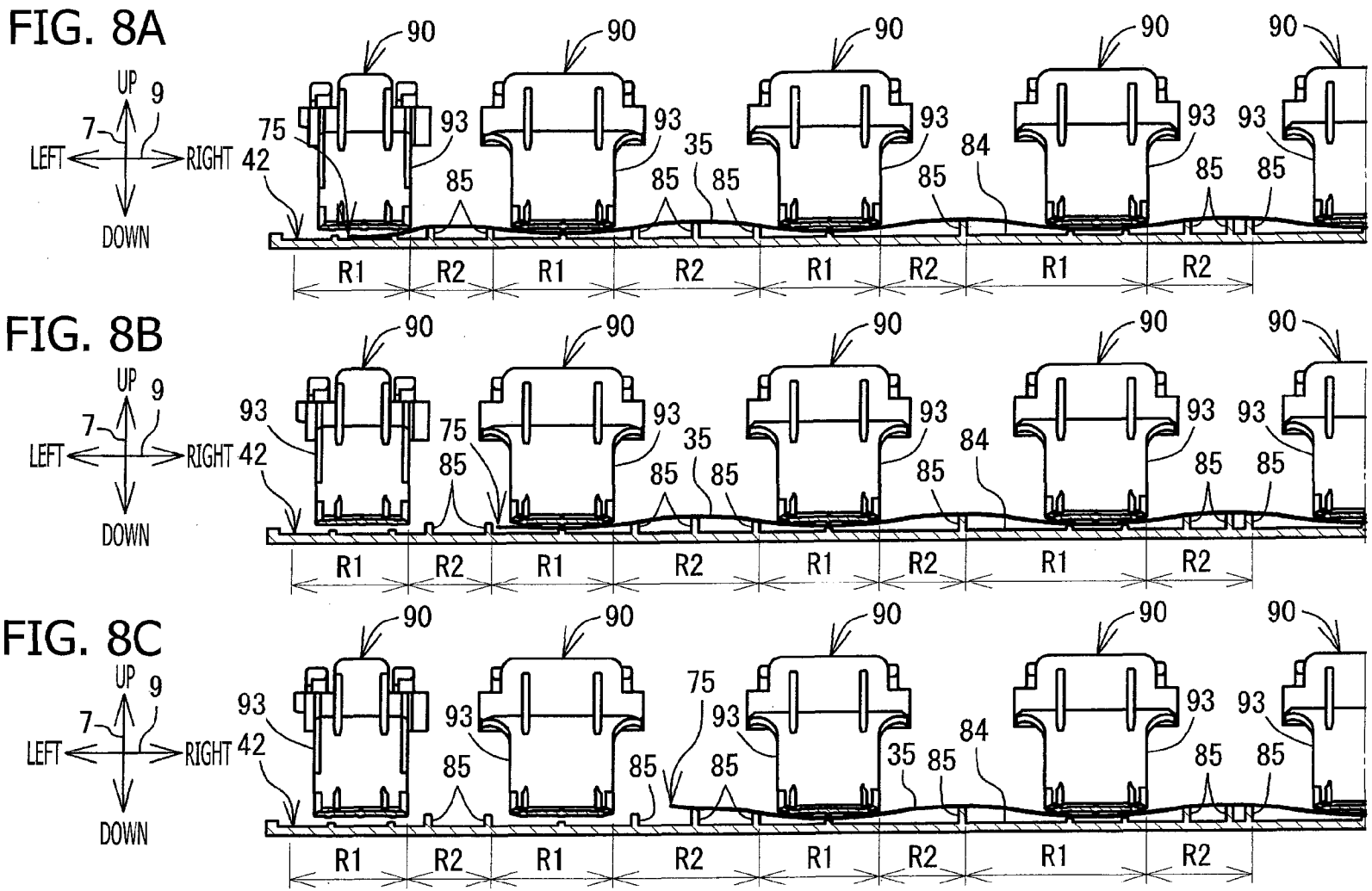
FIG. 8A is a schematic diagram showing a state where a print sheet is fed on a platen in a proper position.
FIG. 8B is a schematic diagram showing a state where a left end of the print sheet is in a region R1 since the print sheet is fed on the platen with the print sheet being displaced to a right side from the proper position.
FIG. 8C is a schematic diagram showing a state where a left end of the print sheet is in a region R2 since the print sheet is fed on the platen with the print sheet being widely displaced to the right side from the proper position.

As shown in FIGS. 8A through 8C, a portion of the pressing part 93 is located below the upper end of the ribs 85. As shown in FIG. 5A, the pressing part 93 is formed in a plate shape and the front end of the pressing part 93 is below the rear end thereof in the front-and-rear direction 8 (i.e., the pressing part 93 is slightly inclined in the horizontal direction). As shown in FIG. 2, the front end of the pressing part 93 in the front-and-rear direction 8 is located rearward of the nozzle face 39 of the recording head 34, and is close to the nozzle face 39.

The portion of the pressing part 93 is located below the upper end of the ribs 85 so as to form the print sheet 35 in the corrugated shape by pressing the print sheet 35 between the ribs 85 and the pressing part 93. The pressing part 93 is inclined so as to prevent the print sheet 35 from getting jammed between the pressing part 93 and the supporting face 84 of the platen 42 (FIG. 3). Additionally, the pressing part 93 is formed in the plate shape so as to arrange the pressing part 93 at a narrowest gap between the recording head 34 and the supporting face 84 of the platen 42. The front end of the pressing part 93 in the front-and-rear direction 8 is close to the nozzle face 39 so as to press the print sheet 35 near the nozzle face 39, thereby improving the quality of the printing.

Further, the front end of the pressing part 93 is tapered so as to be flexible in the up-and-down direction 7. Specifically, the side ends of the pressing part 93 in the right-and-left direction 9 are closer to each other at a portion closer to the front end. The front end of the pressing part 93 is elastically deformed to bend when the print sheet 35 is formed in the corrugated shape. The pressing part 93 is also elastically bent when a print sheet thicker than a regular paper is fed as the print sheet 35 or when the multi-layered print sheets 35 are fed, so as to prevent the print sheet 35 from being jammed between the pressing part 93 and the platen 42.

As shown in FIG. 3, a shape of a pressing part 93 of the each end pressing member 90 disposed at both ends in the right-and-left direction 9 is different from that of the other pressing members 90. Specifically, a front end of the pressing part 93 is formed in substantially a square shape, and not tapered. The end pressing members 90 respectively press the left and right end of the print sheet 35 having a maximum size which is available in the printing unit 11. Thus, the pressing part 93 of the end pressing member 90 is not tapered so as to ensure that the pressing parts 93 press the end portions of the print sheet 35 during the feeding.

[Controller 130]

The controller 130 shown in FIG. 6 controls entire operations performed in the MFP 10. The controller 130 is a microcomputer including a CPU (Central Processing Unit) 131, a ROM (Read Only Memory) 132, a RAM (Random Access Memory) 133, the EEPROM 134, and an ASIC (Application Specific Integrated Circuits) 135. Those elements of the controller 130 are interconnected via an internal bus 137.

The ROM 132 stores various programs executed by the CPU 131 for controlling various operations of the MFP 10. The RAM 133 is used as a storing area for storing various data and signals used by the CPU 131 for executing the programs, or a working area for processing the various data. The EEPROM 134 stores various settings and flags which should be maintained after the MFP 10 is turned off.

The ASIC 135 is electrically connected to the pickup motor 44, the carriage motor 45, the feeding motor 46, the recording head 34, and the LCD panel 47, the linear encoder 64, the rotary encoder 67, the medium sensor 17, the registration sensor 16 and the operation panel 12. Additionally, driving circuits for controlling the each motor are mounted on the ASIC 135.

Further, a pulse signal generated by the reading head of the linear encoder 64 is inputted to the ASIC 135. The controller 130 calculates a travel distance and a position of the carriage 33 based on the pulse signal from the linear encoder 64, and drives the carriage motor 45 so that the calculated travel distance and position conform to target values.

Additionally, a signal generated by the light-receiving element of the medium sensor 17 is inputted to the ASIC 135. The controller 130 checks the signal from the medium sensor 17 while moving the carriage 33 in the right-and-left direction 9. Then, the controller 130 determines positions of right and left ends of the print sheet 35 based on the signal value. Specifically, the controller 130 determines that a position where the signal value is significantly changed is the position of the end of the print sheet 35.

Further, a pulse signal generated by the light-receiving element of the rotary encoder 67 is inputted to the ASIC 135. The controller 130 calculates the amount of rotation of the first feeding roller 60 based on the pulse signal from the rotary encoder 67, and drives the feeding motor 46 so that the calculated amount of rotation conforms to a target value.

Additionally, a first operation signal and a second operation signal from the operation panel 12 are inputted to the ASIC 135. For example, the first operation signal indicates a cancellation of the operation, and the second operation signal indicates an allowance of the operation. These operation signals may be inputted to the ASIC 135 in response to pressing a mechanical button switch or a software button on a touch panel by a user.

[Image Printing Operation]

Figures 7, 7A, 7B:
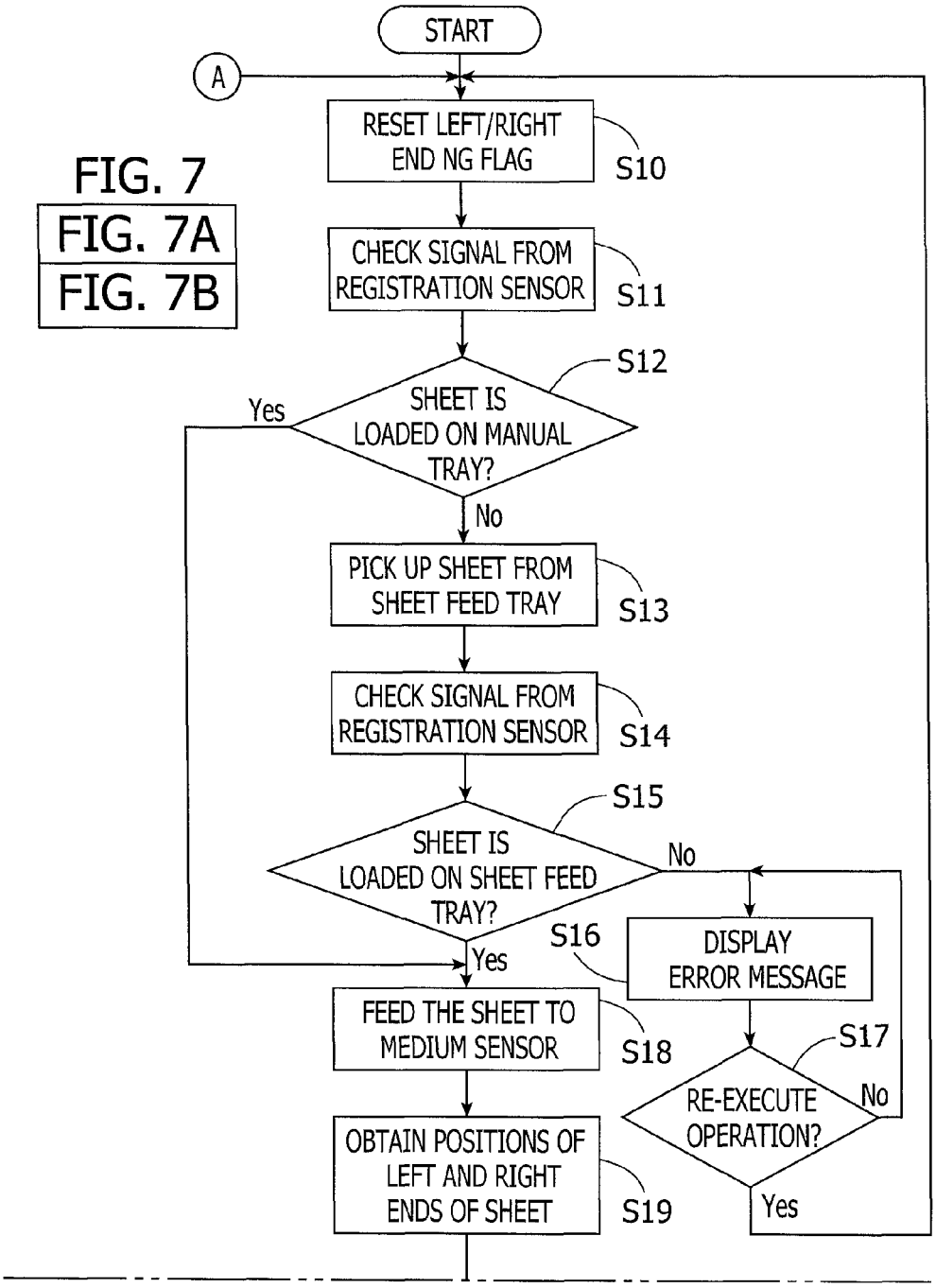
FIG. 7 is a flowchart showing an image printing operation executed by the printing unit.
Figure 7B:
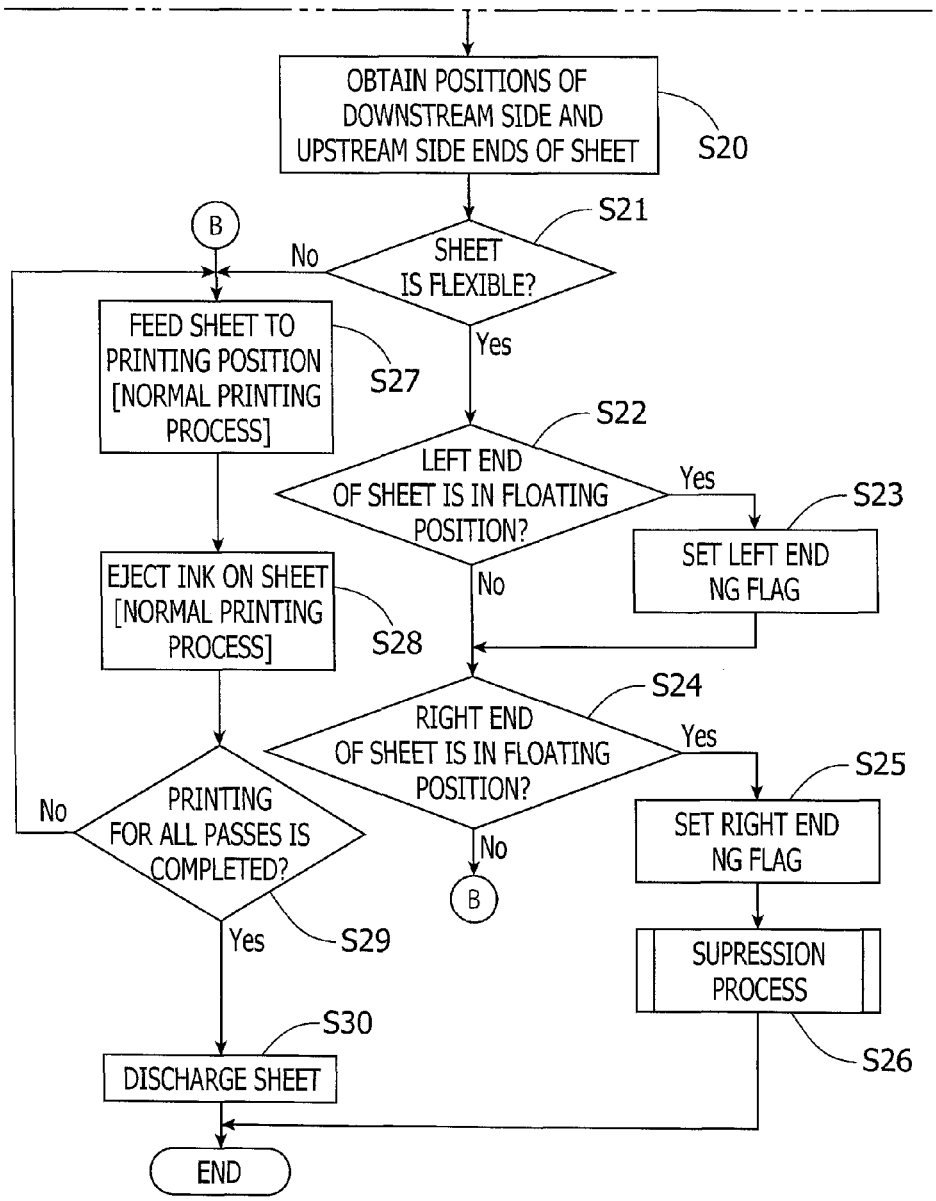

Hereinafter, an image printing operation to print an image on the print sheet 35 performed by the controller 130 is described with reference to FIGS. 7 and 9. The controller 130 starts the image printing operation shown in FIG. 7 in response to a user instruction to start the image printing operation through the operation panel 12 or a personal computer connected to the MFP 10. Firstly, the controller 130 resets a left end NG flag and a right end NG flag stored in the RAM 133 (S10). This step is for initializing the flags which have been set in the previous image printing operation. The details of those flags will be described later.

As described above, when the print sheet 35 is loaded on the manual feed tray 21, the downstream side end of the print sheet 35 is detectable by the registration sensor 16. The controller 130 checks a signal from the registration sensor 16 (S11) and determines whether the print sheet 35 is loaded on the manual feed tray 21 based on the signal (S12).

When the print sheet 35 is not loaded on the manual feed tray 21 (S12: NO), the controller 130 controls the pickup motor 44 to feed the print sheet 35 loaded on the sheet feed tray 20 to the feeding path 65 (S13).

Then, the controller 130 checks a signal from the registration sensor 16 (S14) and determines whether the print sheet 35 is normally fed to the feeding path 65 based on the signal (S15). The controller 130 determines that the print sheet 35 is not loaded on the sheet feed tray 20 when the signal from the registration sensor 16 does not change after the pickup motor 44 rotates a predetermined amount (S15: NO). In this case, the controller 130 controls the LCD panel 47 and/or a display device of the personal computer to display an error message (S16).

This error message is to inform the user that the print sheet 35 is not loaded on the sheet feed tray 20. Additionally, this error message may encourage the user to perform a predetermined operation for re-executing the image printing operation by using the operation panel 12 or the personal computer after the print sheet 35 is loaded on the sheet feed tray 20 or the manual feed tray 21. For example, the error message such as "Load the sheet on the tray and press the START button" may be displayed. The controller 130 controls to continuously display the error message until the user performs the operation for re-executing the image printing operation (S17: NO). When the user performs the operation for re-executing (S17: YES), the controller 130 performs the processes in S10 and the subsequent steps again.

On the other hand, the controller 130 determines that the print sheet 35 is loaded on the sheet feed tray 20 and normally fed to the registration sensor 16 when the signal from the registration sensor 16 changes after the pickup motor 44 rotates the predetermined amount (S15: YES). When the registration sensor 16 detects the print sheet 35 loaded on the sheet feed tray 20 (S15: YES) or the manual feed tray 21 (S12: YES), the controller 130 controls the feeding motor 46 to rotate the first feeding roller 60. Then, the print sheet 35 loaded on the manual feed tray 21 or the print sheet 35 fed from the sheet feed tray 20 through the curved path 65A is nipped by the first roller unit 58 and fed to the platen 42. The controller 130 controls to continuously feed the print sheet 35 until a number of pulses in the pulse signal transmitted from the rotary encoder 67 reaches the target value. As a result, the print sheet 35 is fed to a position to face the medium sensor 17 (S18). At this time, the downstream side of the print sheet 35 which is pressed by the pressing members 90 is formed in the corrugated shape along the right-and-left direction 9 as shown in FIG. 8A through 8C.

Subsequently, the controller 130 controls the carriage motor 45 to move the carriage 33 in the right-and-left direction 9, and obtains positions of the right and left ends of the print sheet 35 based on a signal from the medium sensor 17 (S19). The controller 130 determines that a position where the signal value is equal to or greater than a predetermined value (e.g., a signal value indicating a white part of the print sheet 35) is the position of the right or the left end of the print sheet 35 in the right-and-left direction 9. Then, the positions of the right end and the left end of the print sheet 35 obtained by the controller 130 and signal values which indicate peripheries of the right and the left end of the print sheet 35 are stored in the RAM 133.

The ROM 132 stores a data table including size information of various kinds of print sheets used as the print sheet 35. The controller 130 specifies a size of the print sheet 35 by comparing a distance between the left end and the right end of the print sheet 35 with the size information stored in the ROM 132 (S20). The size specified here is such as A4 size (210 mm×297 mm), B5 size (182 mm×257 mm), L size (89 mm×127 mm) and postcard size (100 mm×148 mm). The controller 130 calculates positions of the upstream side end and the downstream side end of the print sheet 35 in the feeding direction and store the calculated positions in the RAM 133. The position of the downstream side end is calculated based on the amount of the rotation of the first feeding roller 60 (i.e., the number of pulses of the pulse signal generated by the rotary encoder 67) after the registration sensor 16 detects the downstream side end of the print sheet 35. The position of the upstream side end is calculated based on the position of the downstream side end and the size of the print sheet 35 specified based on the size information in the data table.

Then, the controller 130 determines whether the print sheet 35 is very flexible or not based on the size of the print sheet 35 (S21). For example, the controller 130 determines that the print sheet 35 is very flexible when the size of the print sheet 35 is the A4 or B5, and that the print sheet 35 is not very flexible when the size of the print sheet 35 is the L size or the postcard size. Generally, the L size is used for printing a photograph. A print sheet used for printing the photograph or used as a postcard is relatively thick and has stiffness. In this regard, the data table stored in the ROM 132 may include information regarding the flexibility for each size. Alternatively, the user instructions for the image printing operation from the user may include data indicating a type of the print sheet 35 to be printed (e.g., plain paper, gross paper, etc.). In this case, the type of the print sheet 35 is obtained in S21, from the instructions for the image printing operation. Then, the controller 130 determines that the print sheet 35 is very flexible (S21: YES) when the print sheet 35 is a plain paper, or the print sheet 35 is not very flexible (S21: NO) when the print sheet 35 is a gross paper.

When the print sheet 35 is not very flexible (S21: NO), the controller 130 performs a normal printing process for each pass (i.e., processes in S27 and 28). Specifically, the controller 130 controls the first roller unit 58 to feed the print sheet 35 for a predetermined distance at a first feeding speed and stop the print sheet 35 so that a predetermined part of the print sheet 35, on which an image is to be printed, faces the nozzle face 39 (S27). Then, the controller 130 controls the recording head 34 to eject the ink on the print sheet 35 while the carriage 33 is moved in the right-and-left direction 9 at a first carriage speed (S28). The first feeding speed and the first carriage speed are stored in the ROM 132. Accordingly, the normal printing process for a pass is made. It is noted that a "pass" means an operation in which the carriage 33 is moved from one end to the other end of the first and the second guide rails 71 and 72 with the recording head 34 ejecting the ink on the print sheet that is fed and stopped by the controller 130 in S27).

After the normal printing process for the pass is completed, the controller 130 judges whether the normal printing process for all passes is completed (S29). When the normal printing process for all passes is completed (S29: YES), the controller 130 controls the feeding motor 46 to rotate each feeding rollers to discharge the print sheet 35 to the discharge tray 79 (S30). When the normal printing process for all passes is not completed (S29: NO), the controller 130 performs the normal printing process (i.e., the processes in S27 and S28) for next pass until the normal printing process for all passes is completed.

When the print sheet 35 is very flexible (S21: YES), the controller 130 judges whether the left end of the print sheet 35 is in a floating position where the left end portion of the print sheet 35 is likely to float (S22).

FIG. 8A shows a state where the print sheet 35 is fed to the platen 42 properly. A left end 75 of the print sheet 35 is pressed by the end pressing member 90. FIG. 8B shows a state where the print sheet 35 is fed to the platen 42 with the print sheet 35 being displaced to a right side from a proper position. The state show in FIG. 8B could happen when the print sheet 35 is not positioned properly on the sheet feed tray 20 or the manual feed tray 21. FIG. 8C also shows a state where the print sheet 35 is fed to the platen 42 with the print sheet 35 being displaced to the right side from the proper position. The displacement of the state shown in FIG. 8C is greater than that of the state shown in FIG. 8B. It is noted that FIGS. 8A through 8C only show a left half of the platen 42 and the central pressing member 90 is shown at the right end of the figures.

As shown in FIG. 8A through 8C, on the platen 42, regions R1 and regions R2 are set one after the other in the right-and-left direction 9. The ROM 132 stores information regarding positional relationships, in the right-and-left direction 9, between the regions R1 and R2, and the right and left ends of the print sheet 35. It is noted that the regions R1 and the regions R2 are also set on a right half of the platen 42 symmetrically with respect to the left half shown in FIG. 8A through 8C.

The regions R1 are defined such that, when the left end 75 of the print sheet 35 is located in one of the regions R1, one of the pressing members 90 is a member closest to the left end 75 of the print sheet 35 among all the pressing members 90 and the ribs 85 which contact the print sheet 35. Specifically, when the left end 75 of the print sheet 35 is located in one of the regions R1, the left end 75 is pressed by one of the pressing members 90 (as shown in FIG. 8A) or the rib 85 does not exist between the left end 75 and the one of the pressing members 90 (as shown in FIG. 8B). Thus, when the left end 75 of the print sheet 35 is located in one of the regions R1, the left end 75 of the print sheet 35 is not likely to float.

The regions R2 are defined such that, when the left end 75 of the print sheet 35 is located in one of the regions R2, one of the ribs 85 is a member closest to the left end 75 of the print sheet 35 among all the pressing members 90 and the ribs 85 which contact the print sheet 35. Specifically, when the left end 75 of the print sheet 35 is located in one of the regions R2, the left end 75 is not pressed by any of the pressing members 90 and one of the ribs 85 exists between the left end 75 and the pressing member 90 (as shown in FIG. 8C). Thus, when the left end 75 of the print sheet 35 is located in one of the regions R2, the left end 75 of the print sheet 35 is uplifted by one of the ribs 80 close to the left end 75. Therefore, the left end 75 of the print sheet 35 is likely to float compared to the case where the left end 75 of the print sheet 35 is located in one of the regions R1.

The controller 130 judges that the left end 75 of the print sheet 35 is not in the floating position when the left end 75 is in one of the regions R1 (e.g., in the state shown in FIG. 8A or 8B). On the other hand, the controller 130 judges that the left end 75 of the print sheet 35 is in the floating position when the left end 75 is in one of the regions R2 (e.g., in the state shown in FIG. 8C).

When the left end 75 of the print sheet 35 is in the floating position (S22: YES), the controller 130 set the left end NG flag (S23). When the left end 75 of the print sheet 35 is not in the floating position (S22: NO) or after the left end NG flag is set, the controller 130 judges whether the right end of the print sheet 35 is in the floating position or not (S24). This judgment is performed in a similar way to the judgment for the left end 75 in S22. Then, when the right end of the print sheet 35 is in the floating position (S24: YES), the controller 130 set the right end NG flag (S25). In this regard, it is noted that, a value "1" is stored in the RAM 133 when the flag is set, and a value "0" is stored in the RAM 133 when the flag is not set.

When both of the left end and the right end of the print sheet 35 are not in the floating position (S22: NO and S24: NO), the controller 130 performs the normal printing process (i.e., the processes in S27-S30). That is, the normal printing process is performed when the print sheet 35 is not very flexible (S21: NO) or when the left and the right ends of the print sheet 35 are not likely to float. The normal printing process is performed when the left or right end portion of the print sheet 35 does not contact the recording head 34 even if the print sheet 35 is curled by the ink.

On the other hand, when at least one of the left end 75 and the right end of the print sheet 35 is in the floating position (i.e., at least one of the left end NG flag and the right end NG flag has been set), the controller 130 performs a suppression process. Hereinafter, details of the suppression process are described.

[Suppression Process]

Figures 9, 9A:
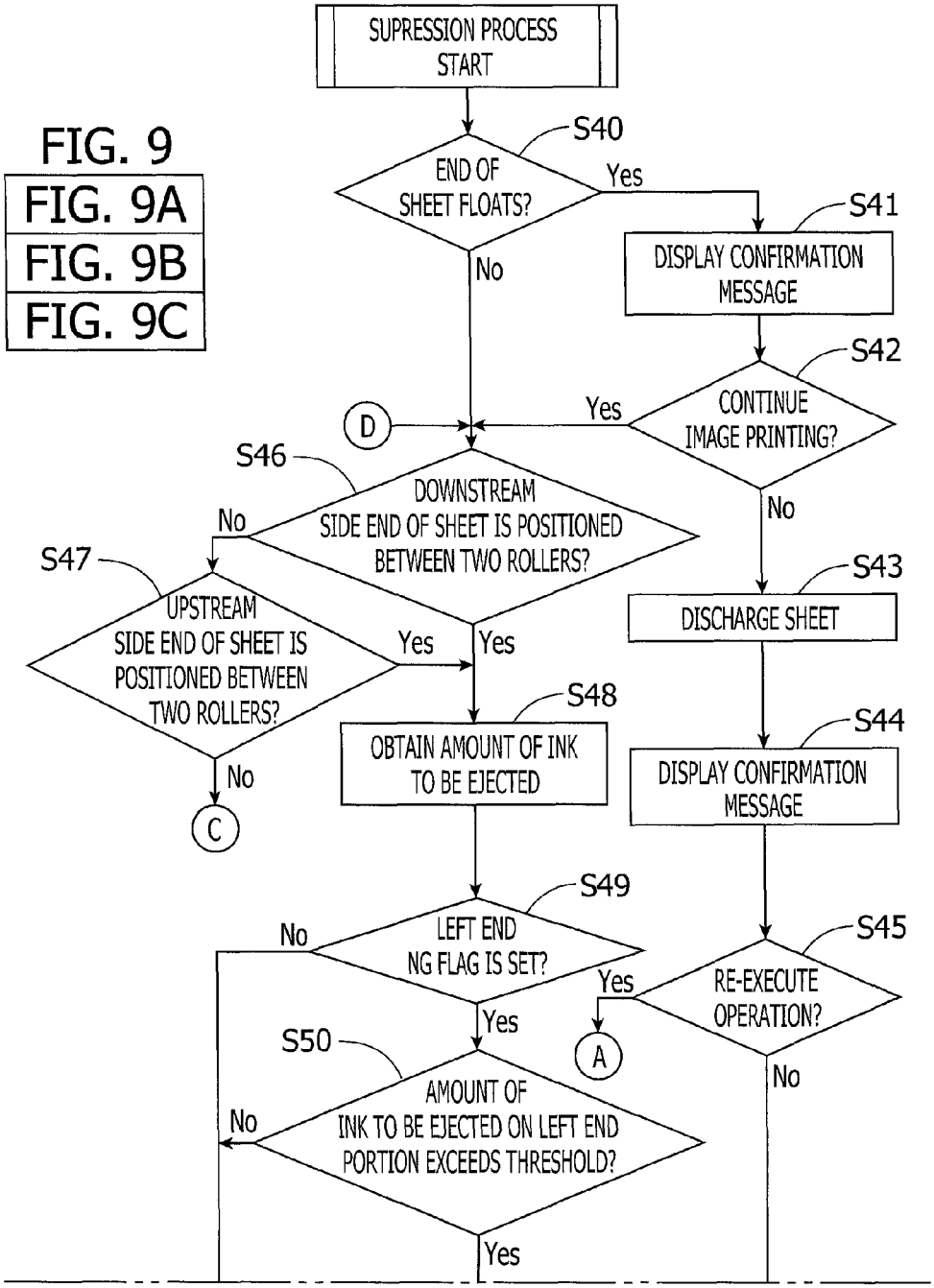
FIG. 9 is a flowchart showing a suppression process shown in the flowchart of FIG. 7.
Figure 9B:
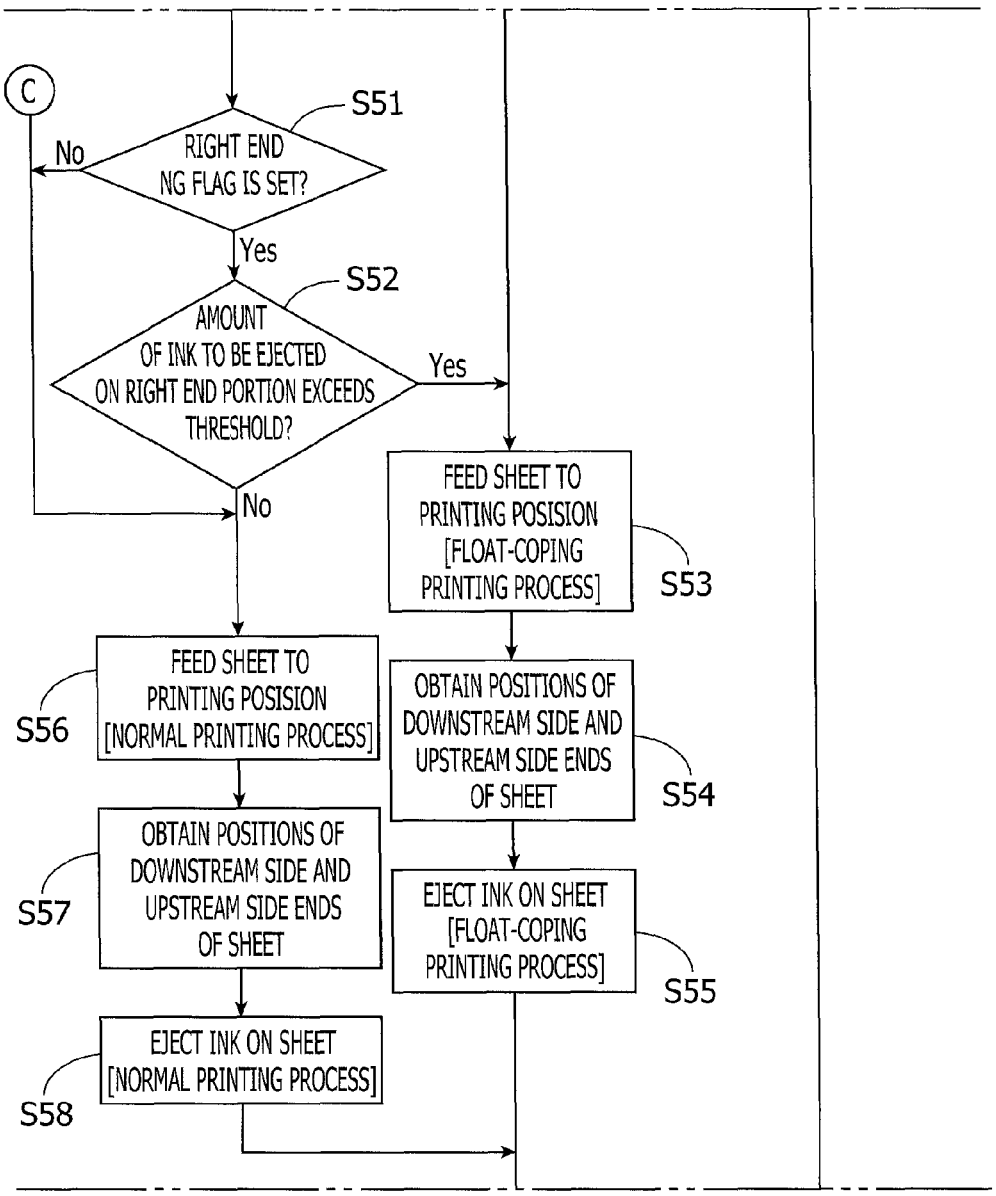
Figure 9C:
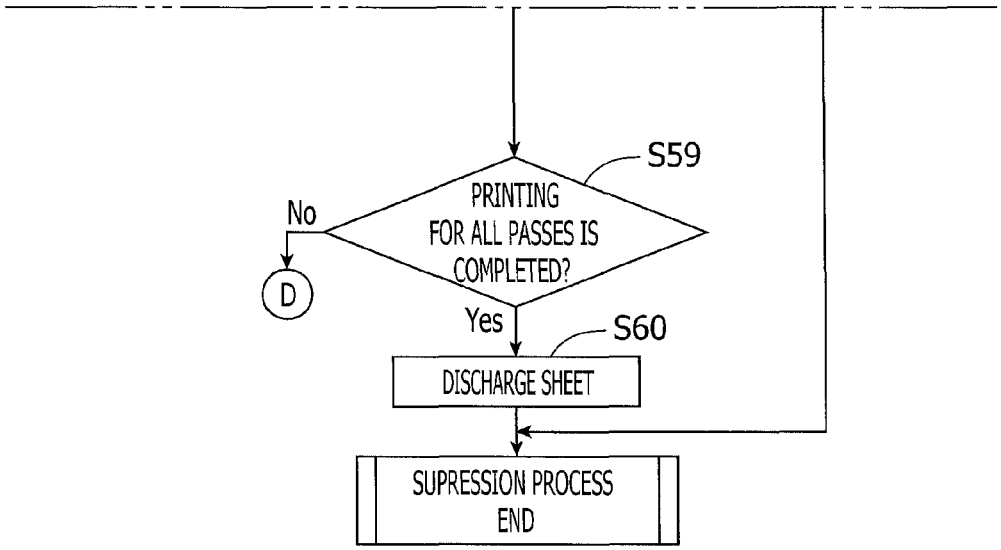

FIG. 9 shows a detailed flowchart of the suppression process in S26. Firstly, the controller 130 judges whether at least one of the end portions of the print sheet 35 floats highly to contact the nozzle face 39 based on the signal value (S40). The signal value is generated by the medium sensor 17 and stored in the RAM 133 in S19. The more a floating amount of the end portion of the print sheet 35 is, the more the intensity of the light reflected at peripheral portions of the print sheet 35 is (i.e., the more the signal value is). The controller 130 compares the signal value from the medium sensor 17 with a threshold value stored in the ROM 132, and judges that the end portion of the print sheet 35 floats highly to contact the nozzle face 39 when the signal value exceeds the threshold value.

When at least one of the end portion is determined to float highly to contact the nozzle face 39 (S40: YES), the controller 130 controls the LCD panel 47 and/or the display device of the personal computer to display a confirmation message to encourage the user to decide whether to continue the image printing operation (S41). For example, the confirmation message, such as "Do you wish to continue the printing?" may be displayed. In addition, icons corresponding to "YES" and "NO" may be displayed on the LCD panel 47 and/or the display device. At this time, the controller 130 controls the feeding motor 46 and the carriage motor 45 to be stopped. It is desirable to stop at least the operation of the carriage motor 45 to prevent the carriage 33 from contacting the end portion of the print sheet 35. The user may select the icon "YES" or "NO" by operating the operation panel 12 or the personal computer.

When the user selects "NO" (S42: NO), the first operation signal is transmitted from the operation panel 12 or the personal computer. In this case, the controller 130 controls the feeding motor 46 to rotate the each feeding roller to discharge the print sheet 35 to the discharge tray 79 (S43). After the print sheet 35 is discharged, the controller 130 controls the LCD panel 47 and/or the display device of the personal computer to display a confirmation message to encourage the user to set the print sheet 35 in a proper position in the sheet feed tray 20 or the manual feed tray 21 and re-execute the image printing operation (S44). For example, the confirmation message, such as "Please set the sheet in a proper position and press 'START.'" may be displayed. Additionally, icons corresponding to "START" and "STOP" are displayed on the LCD panel 47 and/or the display device. The user may select the icon "START" or "STOP" by operating the operation panel 12 or the personal computer.

When the user selects "START" (i.e., the user instructs to re-execute the image printing operation) (S45: YES), the controller 130 re-executes the image printing operation from S10 shown in FIG. 7. When the user selects "STOP" (S45: NO), the controller 130 terminates the suppression process and also the image printing operation is terminated.

On the other hand, when the user selects "YES" in S42 (i.e., when the continuation of the image printing operation is instructed) (S42: YES), the second operation signal is transmitted from the operation panel 12 or the personal computer. In this case, the controller 130 judges whether the downstream side end of the print sheet 35 is located between the first roller unit 58 and the second roller unit 59 based on the information stored in the RAM 133 in S20 (S46). If the downstream side end of the print sheet 35 is not located between the first roller unit 58 and the second roller unit 59 (S46: NO), the controller 130 judges whether the upstream side end of the print sheet 35 is located between the first roller unit 58 and the second roller unit 59 based on the information stored in the RAM 133 in S20 (S47).

When at least one of the downstream side end and the upstream side end of the print sheet 35 is located between the first roller unit 58 and the second roller unit 59 (S46: YES or S47: YES), the print sheet 35 is nipped by only one of the first roller unit 58 or the second roller unit 59. Therefore, it is assumed that the downstream side end or the upstream side end of the print sheet 35 is likely to float. In this case, the controller 130 obtains the amount of the ink to be ejected on the periphery of the ends (hereinafter, referred to as a "left end portion" and a "right end portion", respectively) of the print sheet 35 for a next pass and stores the amount of the ink in the RAM 133. Specifically, the controller 130 calculates the amount of the ink to be ejected to the left end portion and the right end portion of the print sheet 35 based on image data to be printed. It is noted that the left (right) end portion of the print sheet 35 includes the left (right) end and a part having a predetermined length inward from the left (right) end.

Subsequently, the controller 130 judges whether the left end NG flag is set (S49). When the left end NG flag is set (S49: YES), the controller 130 judges whether the amount of the ink to be ejected on the left end portion for the next pass is greater than a threshold stored in the ROM 132 (S50). When the left end NG flag is not set (S49: NO) or when the amount of the ink to be ejected on the left end portion for the next pass is not greater than the threshold (S50: NO), the controller 130 judges whether the right end NG flag is set (S51). When the right end NG flag is set (S51: YES), the controller 130 judges whether the amount of the ink to be ejected on the right end portion for the next pass is greater than the threshold stored in the ROM 132 (S52). The threshold of the amount of the ink may be determined as a value indicating that the ink duty (a proportion of the ink in a predetermined area) is 50%. Alternatively, the threshold of the amount of the ink may be stored in the EEPROM 134. In this case, the EEPROM 134, the operation panel 12 and the controller 130 are adapted to accept a change of the threshold according to the operation by the user.

When the amount of the ink to be ejected on at least one of the right end portion and the left end portion is greater than the threshold (S50: YES or S52: YES), it is expected that the end portion of the print sheet 35 in the right-and-left direction 9 becomes macerated by the moisture of the ink and becomes likely to float. In this case, the controller 130 performs a float-coping printing process for a pass (i.e., processes in S53 and S55).

Specifically, the controller 130 controls the first roller unit 58 and the second roller unit 59 to feed the print sheet 35 for a predetermined distance by a second feeding speed and stop so that a predetermined part of the print sheet 35, on which an image is to be printed, faces the nozzle face 39 (S53). The second feeding speed is slower than the first feeding speed in the normal printing process. The second feeding speed may be 8 ips (inch per second).

Then, the controller 130 obtains the positions of the upstream side end and the downstream side end of the print sheet 35 at the position where the print sheet 35 is stopped in a similar way to the process in S20, and store the positions in the RAM 133 (S54).

Subsequently, the controller 130 controls the recording head 34 to eject the ink on the print sheet 35 while moving the carriage 33 in the right-and-left direction 9 at a second carriage speed (S55). The second carriage speed is slower than the first carriage speed in the normal printing process. The second carriage speed may be 4 ips (inch per second). Accordingly, the float-coping printing process for the pass is made. In the float-coping printing process, by setting the feeding speed of the print sheet 35 to a slower speed, a possibility of additional floating of the end portions of the print sheet 35 due to vibrations during the feeding can be avoided. Additionally, a possibility of the jam of the print sheet 35 at the second roller unit 59 due to an interference of the print sheet 35 with the second roller unit 59 when the downstream side end of the print sheet 35 is nipped by the second roller unit 59 can be also reduced by making the feeding speed slower. Further, by setting the traveling speed of the carriage 33 to a slower speed, a possibility of tear or bend of the end portion of the print sheet 35 contacting the nozzle face 39 can be reduced.

When the negative judgments are made in S47, S51 or S52 (S47: NO, S51: NO or S52: NO), it is assumed that the end portions of the print sheet 35 in the right-and-left direction 9 are not likely to float compared to the case where the S53 is performed. Thus, the controller 130 performs the normal printing process (i.e., processes in S56 and S58). Specifically, the controller 130 feeds the print sheet 35 at the first feeding speed and stops the print sheet 35 at a position where a part of the print sheet 35 to be printed for the pass faces the nozzle face 39 similarly to S27 (S56). Then, the controller 130 obtains positions of the upstream side end and the downstream side end of the print sheet 35, in a similar way to the processes in S20 and S54, at a position where the print sheet 35 is stopped, and store the positions in RAM 133 (S57). Then, the controller 130 controls the recording head 34 to eject the ink on the print sheet 35 while the carriage 33 is moved in the right-and-left direction 9 at the first carriage speed similarly to S28 (S58). Accordingly, the normal printing process for the pass is made.

After the normal printing process or the float-coping printing process for the pass is completed, the controller 130 judges whether the (normal or the float-coping) printing process for all passes is completed (S59). When the printing process for all passes is completed (S59: YES), the controller 130 controls the feeding motor 46 to rotate each feeding rollers to discharge the print sheet 35 to the discharge tray 79 (S60). Then, the controller 130 terminates the suppression process and the image printing operation is also terminated. On the other hand, when the printing process for all passes is not completed (S59: NO), the controller 130 performs the processes in S46 and subsequent steps again until the printing process for all passes is completed.

Effects of the Embodiment

According to the embodiment, the controller 130 displays the confirmation message to allow the user to suspend the image printing operation (S41) when at least one of the ends of the print sheet 35 in the right-and-left direction 9 is located in one the regions R2 (S22: YES or S24: YES), that is, when at least one of the end portions of the print sheet 35 floats highly to contact the nozzle face 39 based on the signal vale of the medium sensor 17 (S40: YES). Since the image printing operation is suspended when the end portion of the print sheet 35 is likely to float and likely to contact the nozzle face 39, the print sheet 35 is prevented from contacting the nozzle face 39.

Additionally, when the image printing operation is suspended at S41, the confirmation message is displayed (S42) so that the user can select whether to re-execute the image printing operation or discharge the print sheet 35.

When the image printing operation is not suspended since the process in S41 is not performed (S40: NO) or the image printing operation is re-executed after the suspension (S42: YES), the float-coping printing process is performed in which a predetermined conditions are applied (S53 and S55). Therefore, even if the end portion of the print sheet 35 contact the nozzle face 39, the print sheet 35 is prevented from getting dirty or jamming in the feeding path 65.

Particularly, when the amount of the ink ejected on at least one of the end portions is greater than the threshold (S50: YES or S52: YES), the float-coping printing process is performed. That is, even when the end portion of the print sheet 35 is macerated by the ink and becomes likely to float, a possibility that the print sheet 35 contacts the nozzle face 39 is reduced.

Additionally, since the correspondence between the positions of the regions R1 and R2 and the positions of the left and the right end of the print sheet 35 is stored in the ROM 132, the controller 130 can determine whether the end of the print sheet 35 is likely to float with few steps.

[Modifications]

Hereinafter, various modifications applicable to the present invention are described. The ROM 132 may store positions of the pressing members 90 and the ribs 85 in the right-and-left direction 9 instead of the positions of the regions R1 and R2. In such case, the controller 130 judges whether the end portion of the print sheet 35 is likely to float based on a relationship between the positions of the pressing members 90 and the ribs 85 and the positions of the ends of the print sheet 35.

Additionally, the controller 130 may determine whether to perform the suppression process based on a condition that is different from the embodiment as described above. For example, the controller 130 may determine to perform the suppression process when the end of the print sheet 35 in the right-and-left direction 9 is located outside the pressing members 90 (i.e., when the end portion of the print sheet 35 is not pressed by the pressing members 90) irrespective of the position of the ribs 85. Alternatively, the controller 130 may determine to perform the suppression process when the end of the print sheet 35 is distanced more than a predetermined distance from the pressing members 90. One example is described hereafter.

Figure 10:
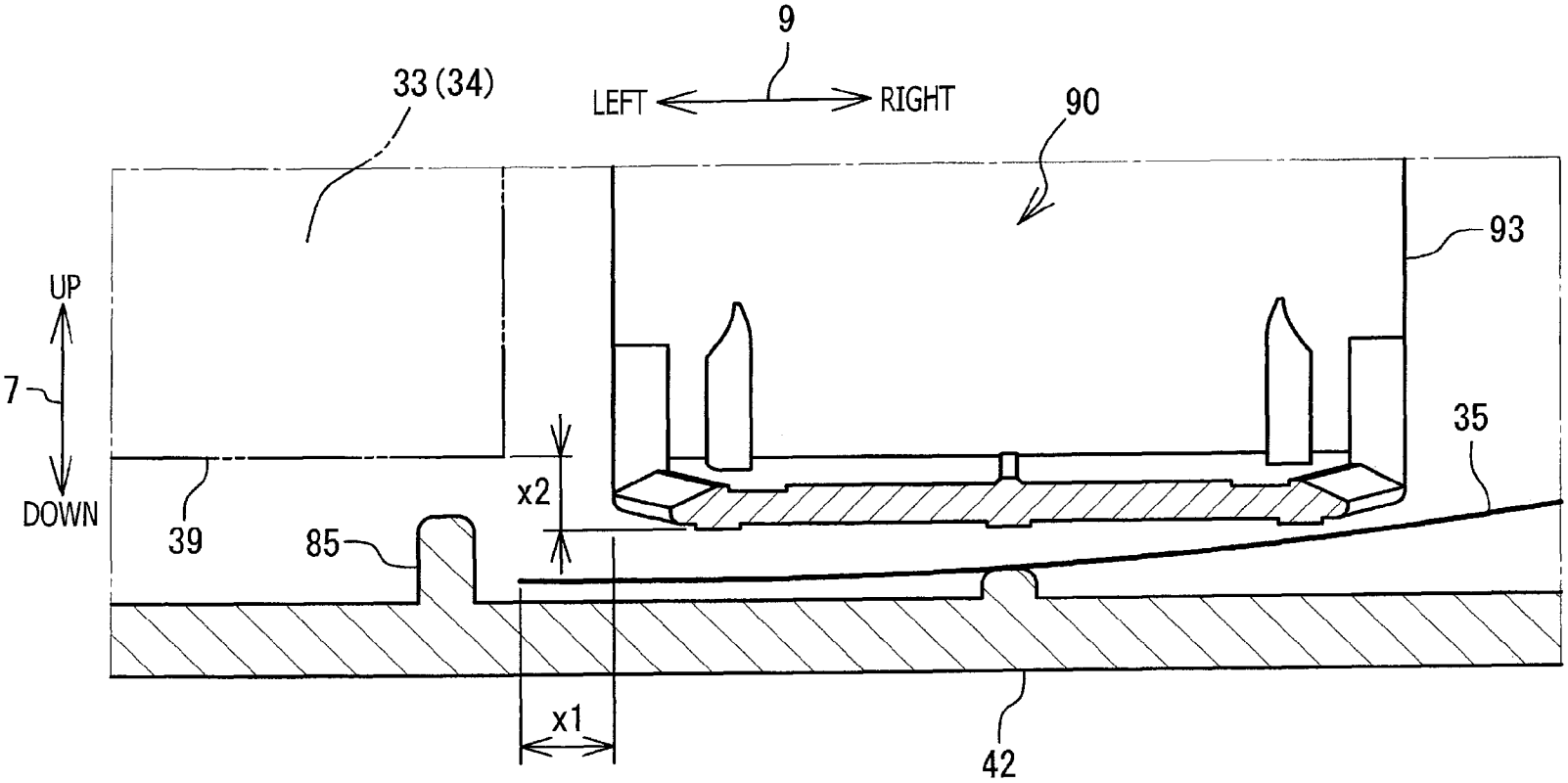
FIG. 10 is a schematic diagram showing conditions (e.g., a distance x1 and x2) used for determining whether to perform the suppression process in a modification of the present invention.

FIG. 10 shows a state where the left end 75 is located on the left side of one of the pressing members 90 by a distance x1. A distance x2 shown in FIG. 10 is a distance between a position where one of the pressing members 90 presses the print sheet 35 and a position of the nozzle face 39 of the recording head 34 in the up-and-down direction 7. When the distance x1 is shorter than the distance x2, the left end 75 of the print sheet 35 cannot reach the nozzle face 39 even if the end portion of the print sheet 35 (i.e., an area corresponding to the distance x1) floats. That is, the left end 75 of the print sheet 35 does not contact the nozzle face 39. On the other hand, when the distance x1 is equal to or longer than the distance x2, the left end 75 of the print sheet 35 may contact the nozzle face 39 as the end portion of the print sheet 35 floats.

The controller 130 compares the distance x1 calculated based on the position of the left end 75 with the distance x2 stored in the ROM 132. Then, the controller 130 performs the suppression process when the distance x1 is equal to or longer than the distance x2. The ROM 132 may store positions of the left end 75 at which the suppression process is not performed (i.e., the distance x1 is shorter than the distance x2) and positions of the left end 75 at which the suppression process is performed (i.e., the distance x1 is equal to or longer than the distance x2) as the regions R1 and R2, respectively. In such case, the controller 130 determines whether to perform the suppression process based on whether the left end 75 is located in the regions R1 or the regions R2. It is noted that only a left half of the platen 42 is shown in FIG. 10, and the controller 130 also performs the judgment for the right end of the print sheet 35 in a similar way.

Additionally, although the controller 130 determines the positions of the ends of the print sheet 35 in the right-and-left direction 9 based on the signal from the medium sensor 17 in the above embodiment, another method for detecting the positions of the ends of the print sheet 35 may be used. For example, the platen 42 may be provided with a plurality of optical or mechanical sensors along the right-and-left direction 9 to detect the ends of the print sheet 35. Alternatively, the positions of the ends of the print sheet 35 may be detected based on a position of a side guide of the sheet feed tray 20 which is used for positioning the print sheet 35 on the sheet feed tray 20 in the right-and-left direction 9. Still alternatively, the user may designate information of the print sheet 35 upon instructing the image printing operation, and the controller 130 stores the information in the EEPROM 134. Then, the controller 130 may determine the size and the positions of the ends of the print sheet 35 based on the information. When the positions of the ends of the print sheet 35 is determined based on the signal value of the medium sensor 17, the position of the print sheet 35 near the recording head 34 can be obtained. In such case, effects of a deformation of the print sheet 35 due to the ejected ink by the recording head 34 and the improper feeding by the sheet supplying unit 15, the first feeding roller 60 and the second feeding roller 62 can be considered by the controller 130 to determine the position of the ends. Therefore, it is preferable to determine the positions of the ends of the print sheet 35 based on the signal value from the medium sensor 17 when compared to the cases based on the position of the side guide of the sheet feed tray 20 and the information of the print sheet 35 stored in the EEPROM 134.

Additionally, some of the steps in the suppression process may be omitted. For example, the confirmation message may be displayed without performing the judgment in S40. Alternatively, the print sheet 35 may be discharged in S60 without displaying the confirmation message. In such a modification, the float-coping printing process is not performed. Further, the processes in S46 and the subsequent steps may be performed without the judgment in S40.

Additionally, the judgments in S 46 and 47 may be omitted. That is, the processes in S48 and the subsequent steps may be preformed irrespective of the position of the ends of the print sheet 35 in the feeding direction.

Further, the float-coping printing process may be performed without judging the amount of the ink in S48-S52.

Additionally, in S55, the controller 130 may control the recording head 34 so that the total amount of the ink ejected on the print sheet 35 in the float-coping printing process is less than the total amount of the ink in the normal printing process. According to this, the amount of the moisture of the ink which sinks into the print sheet 35 is reduced, and the floating of the print sheet 35 in the right-and-left direction 9 is suppressed. It is desirable to set the total amount of the ink, which is less than that of in the normal printing process, to a value that the ink duty is equal to or less than 50%. Additionally, the user may designate whether to reduce the total amount of the ink when the image printing operation is performed. In such case, it is desirable to omit the judgments in S46 and S47 since the density of the ink would be varied in the feeding direction depending on the judgment results in S46 and 47.

Further, in the float-coping printing process, the controller 130 controls the first roller unit 58 so that a sheet feeding speed of the print sheet 35 is reduced when the downstream side of the print sheet 35 passes the second roller unit 59 (i.e., when the print sheet 35 is nipped by the second roller unit 59). Specifically, the controller 130 may feed the print sheet 35 to the second roller unit 59 in a first sheet feeding speed stored in the ROM 132, and changes the first sheet feeding speed to a second sheet feeding speed which is slower than the first sheet feeding speed just before the downstream side end of the print sheet 35 is nipped by the second roller unit 59. The second sheet feeding speed may be set as 8 ips (inch per second). If the downstream side end of the print sheet 35 floats highly, the print sheet 35 is not nipped by the second roller unit 59 properly. Especially, the print sheet 35 may be nipped by the second roller unit 59 with the print sheet 35 bending. This could be prevented by reducing the sheet feeding speed of the print sheet 35 when the print sheet 35 is nipped by the second roller unit 59. Accordingly, the floating of the downstream side end of the print sheet 35 is suppressed.

Additionally, when the processes in S28, S55 and S58 are performed, the controller 130 may judge whether a predetermined period of time has passed after the carriage 33 was stopped in the steps S28, S55 and S58 for the previous pass. If the predetermined period of time has not passed, the controller 130 suspends the movement of the carriage 33 until the predetermined period of time has passed. The end portions of the print sheet 35 in the right-and-left direction 9 are likely to float by the moisture of the ink immediately after the ejection of the ink. The predetermined period of time is set in view of a period of time for drying the ink. For example, the predetermined period of time in the float-coping printing process (S55) (a second period of time) is longer than a first period of time in the normal printing process (S28 and S58). The second period of time may be set to about 10 seconds. In this modification, the movement of the carriage 33 is suspended until the predetermined period of time (the first or the second period of time) has passed after the ink is ejected for the previous pass. According to this, the floating of the end portion of the print sheet 35 is suppressed and, as a result, the end portion of the print sheet 35 is suppressed from contacting the nozzle face 39.

So far, processes for reducing the feeding speed of the print sheet 35, reducing the traveling speed of the carriage 33, reducing the amount of the ink, reducing the sheet feeding speed of the print sheet 35 when nipped by the second roller unit 59, and increasing the suspended time of the carriage 33 are described as examples in the float-coping printing process. When the image printing operation for the print sheet 35 is performed, all of these processes or a combination of some of those processes, or only one of those processes may be performed in the float-coping printing process.

Additionally, the controller 130 may omit the processes from S40 to S45.

Further, the recording head 34 may be a so-called line head extending across the right-and-left direction 9 of the print sheet 35 instead of the recording head 34 carried by the carriage 33. In such a modification, reducing the traveling speed of the carriage 33 and increasing the suspended time of the carriage 33 may be omitted since there is no carriage 33.

Further, in the embodiment, the printing unit 11 may print the image on one side of the print sheet 35. However, the printing unit 11 may perform a both side printing of the print sheet 35. In this case, the printing unit 11 may include additional feeding path and feeding rollers to turn over the print sheet 35 and feed the same to the platen 42.

Only an exemplary embodiment of the disclosure and a few examples of their versatility are shown and described in the disclosure. It is to be understood that the disclosure is capable of use in various other combinations and environments and is capable of changes or modifications within the scope of the inventive concept as expressed herein.

What is claimed is:

1. An inkjet printer comprising:

a feeding device configured to feed a sheet in a feeding direction;

a platen configured to support the sheet fed by the feeding device;

a recording device configured to eject ink from nozzles on a recording side of the sheet supported by the platen;

a plurality of contacting members disposed between, in the feeding direction, the feeding device and the recording device and configured to contact the recording side of the sheet, the contacting members being arranged at intervals in a width direction which is orthogonal to the feeding direction, a detector configured to detect an end portion position of the sheet in the width direction; and a controller configured to control the feeding device and the recording device, wherein the controller performs a suppression process in which at least one of the feeding device and the recording device is controlled to suppress a contact of the sheet with the recording device when the end portion position detected by the detector is a position between the two adjacent contacting members.

2. The inkjet printer according to claim 1, wherein the controller performs the suppression process when the end portion position is distanced more than a predetermined distance from one of the contacting members that is a member closest to the end portion position.

3. The inkjet printer according to claim 1, wherein a contact position where the contacting members contact the sheet is between the platen and the nozzle in a height direction which is orthogonal to the feeding direction and the width direction, and wherein the controller performs the suppression process when a first distance between the end portion position of the sheet and one of the contacting members that is a member closest to the end portion position in the width direction is longer than a second distance between the contact position and the nozzles in the height direction.

4. The inkjet printer according to claim 1, further comprising a plurality of ribs formed extending along the feeding direction on the platen to contact a back side of the sheet, the back side being a reverse side of the recording side, the plurality of ribs and the plurality of contacting members being arranged alternately, wherein the controller performs the suppression process when the end portion position is located between one of the ribs, which contacts the sheet and is closest to the end portion position of the sheet, and one of the contacting members, which does not contact the sheet and is closest to the end portion position of the sheet.

5. The inkjet printer according to claim 4, wherein a first contact position where the ribs contact the sheet is a position between the recording device and a second contact position where the contacting members contact the sheet in a height direction which is orthogonal to the feeding direction and the width direction.

6. The inkjet printer according to claim 4, further comprising a storage configured to store a predetermined region in the width direction, wherein the controller performs the suppression process when the end portion position detected by the detector is located in the predetermined region, and wherein the predetermined region is defined, such that when the end portion position is located in the predetermined region, one of the ribs is a member closest to the end portion positions among all the contacting members and the ribs which contact the sheet.

7. The inkjet printer according to claim 4, further comprising a storage configured to store positions of the contacting members and the ribs, and wherein the controller performs the suppression process when one of the ribs is a member closest to the end portion position among all the contacting members and the ribs which contact the sheet, based on the end portion position of the sheet, the contacting members and the ribs.

8. The inkjet printer according to claim 1, wherein the detector is disposed on the recording device and includes an optical sensor having a light emitting element configured to emit a light to the sheet or the platen and a light receiving element configured to receive the light reflected from the sheet or the plated, and wherein the detector detects a position at which an amount of the light received by the light receiving element exceeds a predetermined amount as the end portion position of the sheet.

9. The inkjet printer according to claim 1, wherein the controller performs the suppression process when the sheet is a plain sheet.

10. The inkjet printer according to claim 1, wherein the feeding device includes an upstream side rollers configured to nip the sheet at an upstream side of the recording device in the feeding direction, and a downstream side rollers configured to nip the sheet at a downstream side of the recording device in the feeding direction, wherein the controller performs the suppression process when the sheet is nipped by only the upstream side rollers or the downstream side rollers.

11. The inkjet printer according to claim 1, wherein the suppression process includes a suspend process to suspend an operation of at least one of the feeding device and the recording device.

12. The inkjet printer according to claim 1, wherein the suppression process includes a float-coping printing process for printing an image on the sheet, in which the controller controls:

the feeding device to feed the sheet at a speed which is slower than a predetermined speed;

the recording device, which is configured to move in the width direction, to move in the width direction at a speed which is slower than a predetermined speed; or the recording device to eject the ink on the sheet where an amount of the ink is less than a predetermined amount.

13. The inkjet printer according to claim 11, further comprising:

a discharge tray to which the sheet is discharged; and an operation device configured to generate an operation signal in response to a user operation, wherein the controller controls the feeding device to feed the sheet to the discharge tray when the operation signal is generated by the operation device after the suspend process is performed.

14. The inkjet printer according to claim 11, further comprising:

a discharge tray to which the sheet is discharged; and an operation device configured to generate a first operation signal and a second operation signal in response to a user operation, wherein the suppression process includes a float-coping printing process for printing an image on the sheet, in which the controller controls:

the feeding device to feed the sheet at a speed which is slower than a predetermined speed;

the recording device, which is configured to move in the width direction, to move in the width direction at a speed which is slower than a predetermined speed; or the recording device to eject the ink on the sheet where an amount of the ink is less than a predetermined amount, wherein the controller controls the feeding device to feed the sheet to the discharge tray when the first operation signal is generated by the operation device after the suspend process is performed, and wherein the controller performs the float-coping printing process when the second operation signal is generated by the operation device after the suspend process is performed.

15. The inkjet printer according to claim 14, wherein the controller is further configured to calculate an amount of the ink ejected on the sheet based on image data indicating the image to be printed on the sheet, and wherein the controller performs the float-coping printing process when the calculated amount of the ink exceeds a predetermined threshold.

16. The inkjet printer according to claim 15, wherein the controller calculates the amount of the ink ejected on a predetermined part of the sheet, the predetermined part including a predetermined side end portion of the sheet.

17. The inkjet printer according to claim 12, wherein the controller is further configured to perform a normal printing process for printing an image on the sheet, in which the controller controls the feeding device to feed the sheet at a first feeding speed, and, wherein, in the float-coping printing process, the controller controls the feeding device to feed the sheet at a second feeding speed which is slower than the first feeding speed.

18. The inkjet printer according to claim 12, wherein the recording device is configured to eject the ink on the sheet while moving in the width direction, wherein the controller is further configured to perform a normal printing process for printing an image on the sheet, in which the controller controls the recording device to move at a first traveling speed, and, wherein, in the float-coping printing process, the controller controls the recording device to move at a second traveling speed which is slower than the first traveling speed.

19. The inkjet printer according to claim 12, wherein the feeding device includes:

a roller disposed at a downstream side of the recording device in the feeding direction; and a driven roller configured to nip the sheet with the roller, wherein, in the float-coping printing process, the controller controls the feeding device to feed the sheet at a first feeding speed, and, before the sheet is nipped between the roller and the driven roller, the controller controls the feeding device to reduce the feeding speed to a second feeding speed which is slower than the first feeding speed.

20. The inkjet printer according to claim 12, wherein the controller is further configured to perform a normal printing process for printing the image on the sheet, wherein the controller performs the float-coping printing process or the normal printing process for each pass, wherein, in each pass, the recording device ejects, while moving in the width direction, the ink on the sheet which is fed and stopped by the feeding device, wherein, in the normal printing process, the controller sets a time interval of each pass to a first period of time, and, wherein, in the float-coping printing process, the controller sets the time interval of each pass to a second period of time which is longer than the first period of time.

* * * * *